US007090474B2

(12) United States Patent
Lehrke et al.

(10) Patent No.: US 7,090,474 B2
(45) Date of Patent: Aug. 15, 2006

(54) DIAPHRAGM PUMP WITH OVERFILL LIMITER

(75) Inventors: Kenneth Eugene Lehrke, Maple Grove, MN (US); Richard D. Hembree, Bellingham, WA (US)

(73) Assignee: Wanner Engineering, Inc., Minneapolis, MN (US)

( * ) Notice: Subject to any disclaimer, the term of this patent is extended or adjusted under 35 U.S.C. 154(b) by 103 days.

(21) Appl. No.: 10/439,535

(22) Filed: May 16, 2003

(65) Prior Publication Data

US 2004/0228748 A1 Nov. 18, 2004

(51) Int. Cl.
*F04B 43/06* (2006.01)

(52) U.S. Cl. ..... 417/395; 417/385; 417/388; 417/386; 96/129; 96/110; 96/13.6; 92/84; 92/96; 92/101; 92/98 R

(58) Field of Classification Search ..... 417/395, 417/385, 386, 388, 46; 92/129, 13.6, 109, 92/110, 98 R, 83, 84, 96, 101
See application file for complete search history.

(56) References Cited

U.S. PATENT DOCUMENTS

| | | | | | |
|---|---|---|---|---|---|
| 1,976,151 | A | * | 10/1934 | Thaheld | 417/490 |
| 3,416,461 | A | * | 12/1968 | McFarland | 417/568 |
| 3,680,981 | A | * | 8/1972 | Wagner | 417/388 |
| 3,769,879 | A | * | 11/1973 | Lofquist, Jr. | 92/84 |
| 3,775,030 | A | | 11/1973 | Wanner | |
| 3,884,598 | A | | 5/1975 | Wanner | |
| 3,953,154 | A | | 4/1976 | Wanner | |
| 4,430,048 | A | * | 2/1984 | Fritsch | 417/383 |
| 5,667,368 | A | * | 9/1997 | Augustyn et al. | 417/385 |
| 5,707,219 | A | * | 1/1998 | Powers | 417/386 |
| 6,468,056 | B1 | | 10/2002 | Murakoshi | |
| 6,582,206 | B1 | * | 6/2003 | Schluecker | 417/395 |

* cited by examiner

*Primary Examiner*—Timothy S. Thorpe
*Assistant Examiner*—Emmanuel Sayoc
(74) *Attorney, Agent, or Firm*—Merchant & Gould P.C.

(57) ABSTRACT

A diaphragm pump which overcomes the problem of diaphragm failure due to overfill of the oil transfer chamber. An overfill preventive element in the form of a mechanical stop, a fully closed coil spring, or a valve system, or alternatives are provided.

9 Claims, 15 Drawing Sheets

FIG. 7D OUTPUT STROKE
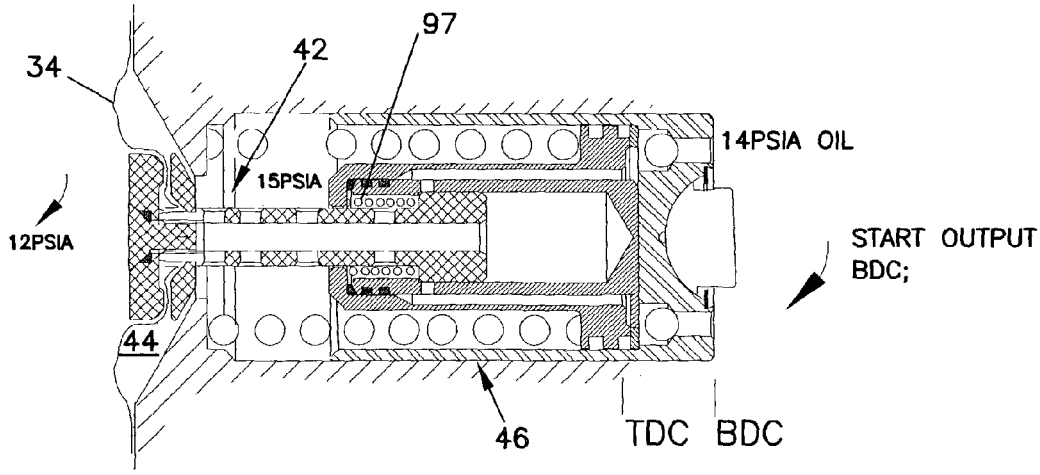
FIG. 7E
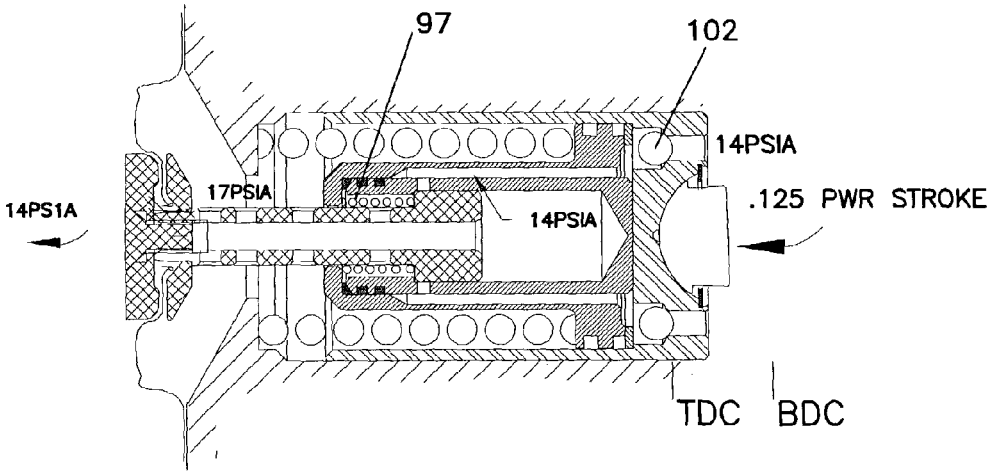
FIG. 7F
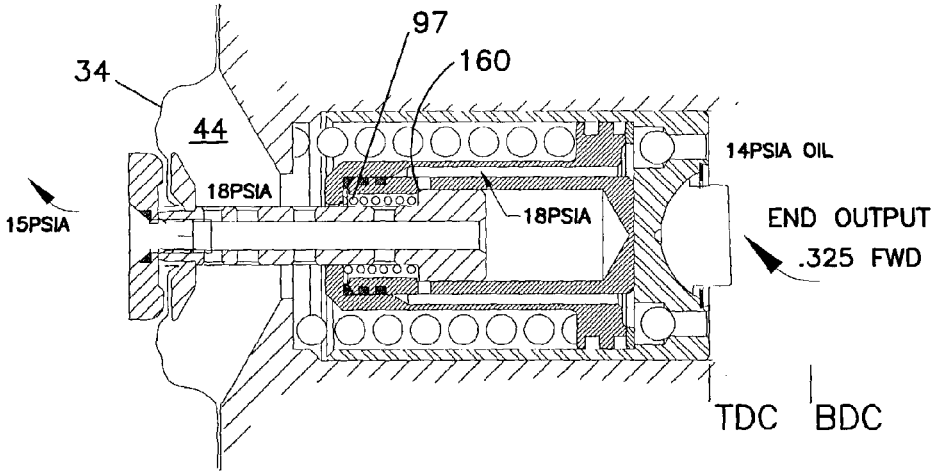

DIAPHRAGM PUMP WITH OVERFILL LIMITER

FIELD OF THE INVENTION

The present invention relates generally to an improved diaphragm pump, and more specifically, to an improved diaphragm pump which includes an overfill preventive element on the hydraulic drive side of the diaphragm.

DESCRIPTION OF THE ART

The known rotary-operated, oil-backed/driven diaphragm pump is a high-pressure pump inherently capable of pumping many difficult fluids because in the process fluid, it has no sliding pistons or seals to abrade. The diaphragm isolates the pump completely from the surrounding environment (the process fluid), thereby protecting the pump from contamination.

In general, a diaphragm pump 20 is shown in FIG. 1. Pump 20, driven by a motor 21, has a drive shaft 22 rigidly held in the pump housing 24 by a large tapered roller bearing 26 at the rear of the shaft and a small bearing (not shown) at the front of the shaft. Sandwiched between another pair of large bearings (not shown) is a fixed-angle cam or wobble plate 28. As the drive shaft turns, the wobble plate moves, oscillating forward and back converting axial motion into linear motion. The three piston assemblies 30 (only one piston assembly is shown) are alternately displaced by the wobble plate 28. As shown later, each piston is in an enclosure including a cylinder such that the enclosure is filled with oil. A ball check valve 32 in the bottom of the piston/cylinder assembly 30 functions to allow oil from a reservoir 27 (wobble plate 28 is in the reservoir) to flow toward the enclosure on the suction stroke. During the output or pumping stroke, the held oil in the enclosure pressurizes the backside of diaphragm 34 and as the wobble plate moves, causes the diaphragm to flex forward to provide the pumping action. Ideally, the pump hydraulically balances the pressure across the diaphragm over the complete design pressure range. As discussed later, in actual practice this is not the case for all situations for known pumps. In any case, each diaphragm has its own pumping chamber which contains an inlet and an outlet check valve assembly 36, 37 (see also FIG. 2). As the diaphragm retracts, process fluid enters the pump through a common inlet and passes through one of the process fluid inlet check valves. On the output or pumping stroke, the diaphragm forces the process fluid out the process fluid discharge check valve and through the manifold common outlet. The diaphragms, equally spaced 120° from one another, operate sequentially to provide constant, virtually pulse-free flow of process fluid.

In more detail, a portion of a diaphragm pump 20 is shown in cross-section in FIG. 2. The diaphragm 34 is held between two portions 38, 40 of housing 24. Diaphragm 34 separates the pump side from the oil-filled, hydraulic drive side of the pump. On the drive side, a drive piston assembly 30 including a diaphragm plunger 42 are contained within the oil filled enclosure which functions as a transfer chamber 44. A plurality of check valves 32 in piston 46 separate transfer chamber 44 from the oil reservoir (not shown). Wobble plate 28 (not shown in FIG. 2) contacts pad 48 to drive piston 46. Arrow 49 indicates the general direction of movement of the cam or wobble plate. When the piston and diaphragm have finished the forward or pumping stroke, the end 50 of piston 46 is at top dead center (TDC). When the piston and diaphragm have retracted in the suction stroke, the end 50 of piston 46 is at bottom dead center (BDC).

Piston 46 reciprocates in cylinder 47. Piston 46 has a sleeve section 52 which forms the outer wall of the piston. Sleeve section 52 includes a sleeve 54 and an end portion 56 at the end having pad 48 which is contact with the wobble plate. Within sleeve 54 is contained a base section 58. Base section 58 includes a first base 60 which is in contact with end portion 56 and includes seal elements 62 for sealing between first base 60 and sleeve 54. Base section 58 also includes second base 64 at the end opposite of first base 60. Connecting wall 66 connects first and second bases 60 and 64. Piston return spring 68 is a coil spring which extends between first base 60 and diaphragm stop 70 which is a part of the pump housing 24. Valve housing 72 is contained within base section 58 and extends between second base 64 and end portion 56. Seals 74 provide a seal mechanism between valve housing 72 and connecting wall 66 near second base 64.

The end 76 opposite end portion 56 of sleeve portion 52 is open. Likewise, the end 78 of valve housing 72 is open. Second base 64 has an opening 80 for receiving the stem 82 of plunger 42.

Diaphragm plunger 42 has the valve spool 84 fitted within valve housing 72 with the stem 82 extending from the valve spool 84 through opening 80 to head 86 on the transfer chamber side of diaphragm 34. Base plate 88 is on the pumping chamber side of diaphragm 34 and clamps the diaphragm to head 86 using a screw 90 which threads into the hollow portion 92 of plunger 42. Hollow portion 92 extends axially from one end of plunger 42 to the other end. Screw 90 is threaded into the diaphragm end. The valve spool end of hollow portion 92 is open. A plurality of radially directed openings 94 are provided in stem 82. A bias spring 96 is a coil spring and extends between second base 64 and valve spool 84. A valve port 98 is provided in the wall of valve housing 72. A groove 100 extends in connecting wall 66 from valve port 98 to end portion 56. A check valve 32 is formed in end portion 56 in a passage 104 which is fluid communication with the reservoir (not shown). Thus, there is fluid communication from the reservoir (not shown) through passage 104 and check valve 32 via groove 100 to valve port 98. When the spool valve is open, there is further communication through the space in which coil spring 96 is located and then through one of the plurality of radial openings 94 and through the axial hollow portion 92 of plunger 84. There is further fluid communication from the hollow portion 92 through the other radially directed openings 94 to various portions of transfer chamber 44. The hollow passage 92, along with the radially directed openings 94 provide fluid communication from the portion of transfer chamber 44 near diaphragm 34 to the portion of transfer chamber 44 within the valve housing 72 of piston 30. The transfer chamber also includes the space occupied by piston return spring 68.

On the pump side of diaphragm 34, there is an inlet check valve assembly 36 which opens during the suction stroke when a vacuum is created in pumping chamber 106. There is also a check valve 37 which opens during the pumping or output stroke when pressure is created in pumping chamber 106.

FIGS. 3(*a*)–(*f*) illustrate operation of the conventional pump 20 under normal, standard operating conditions using a conventional bias spring 96. Typical pressures are shown. Typical vector directions for the cam or wobble plate (not shown in FIGS. 3(*a*)–(*f*)) are shown. Suction is less than 14.7 psia. Output pressure is greater than 14.7 psia. The pressure differential across diaphragm 34 is set at about 3 psi.

With reference to FIG. 3(*a*), the suction stroke begins at the end of the pumping stroke. For the conditions assumed, pressure in the pumping chamber immediately drops from what it was at high pressure, for example, 120 psia to 10 psia. Pressure in the hydraulic transfer chamber is 13 psia which is less than the 14.7 psia in the reservoir. The piston 30 is at top dead center and begins moving toward bottom dead center. Bias spring 96 momentarily moves plunger 42, and particularly valve spool 84, to the right to open port 98. Because pressure in the transfer chamber is less than the pressure in the reservoir, check valve 32 opens and oil flows from the reservoir to the transfer chamber to appropriately fill it with oil which had been lost during the pumping stroke previous. That is, under the pressure of the pumping stroke oil flows through somewhat loose tolerances of the parts of the piston so that some of the oil flows from the transfer chamber back to the reservoir. Thus oil needs to be refilled in the transfer chamber during the suction stroke so that there is enough oil to efficiently provide pressure during the next pumping stroke.

FIG. 3(*b*) shows the configuration at mid-stroke. The slight suction in the pumping chamber (shown to be 10 psia), holds diaphragm 34 and spool 84 to the left while piston 30 moves to the right, thereby shutting off port 98. Since pressures are nearly equal and diaphragm 34 moves right with piston 30, the pumping chamber fills with process fluid.

As shown in FIG. 3(*c*), process fluid continues to fill as diaphragm 34 moves right. Valve port 98 remains shut. Very little leakage of oil occurs from the reservoir (not shown) to transfer chamber 44, since pressures are nearly equal. Thus, both sides of the diaphragm fill properly.

When piston 30 reaches bottom dead center, the suction stroke is completed and the output or pumping stroke begins as shown in FIG. 3(*d*). Pressure in the transfer chamber immediately increases, for example, from 13 psia to 123 psia. Likewise, pressure in the pumping chamber immediately increases, for example, from 10 psia to 120 psia. The wobble plate begins moving piston 30 to the left which causes the build-up of pressure. Check valves 32 close. Diaphragm 34 moves in volume tandem with the oil and process fluid left with the piston to push (pump) process fluid out.

At mid-stroke as shown in FIG. 3(*e*), there is continued output. Some oil leakage past the tolerances between piston and cylinder may move valve spool 84 of diaphragm plunger 42 to the right to open valve port 98. Check valves 32, however, are closed, thereby locking the oil in transfer chamber 44, except for leakage.

The output stroke finishes with the configuration shown in FIG. 3(*f*). The filled transfer chamber 44 pushes diaphragm 32 to the left dispensing process fluid as it moves. Normal operation as shown in FIGS. 3(*a*)–(*f*) causes little stress on diaphragm 32.

A problem with conventional diaphragm pumps, however, is an unexpected diaphragm rupture under certain operating conditions. The diaphragm can fail much sooner than normal, or more frequently, may fail sooner than other pump components. A failure contaminates the process lines with drive oil. The operating condition which most often causes failure is a high vacuum inlet with a corresponding low outlet pressure. This is an expected occurrence in a typical pumping system when the inlet filter begins to plug. In that case, the plugging requires high vacuum to now pull process fluid through the filter. At the same time, the lowering of process fluid volume pumped drops the outlet pressure. This creates a situation where a high suction on the pumping side lowers the pressure during the suction stroke on the transfer chamber side so that the transfer chamber essentially "asks for more fill fluid" and, consequently, in-flowing oil overfills the transfer chamber and does so without a corresponding high pressure to push oil out during the pumping or output stroke to counter-balance. The overfill of oil "balloons" the diaphragm into the fluid valve port until the diaphragm tears. Additionally, with a high-speed, reversing, vacuum/pressure pump such as this apparatus, the high-speed valve closings create tremendous pressure spikes, called Jaukowski shocks. The spikes can consist of fluid pressure or acoustical waves and harmonics of both. These pressure spikes can "call for" oil fluid flow into the drive piston when that should not be happening. Again, this can cause overfill and lead to the diaphragm failure. FIGS. 4(*a*)–4(*f*) are provided to illustrate the overfill failure mode.

In FIG. 4(*a*), the suction stroke begins. Since it is assumed that the inlet side for the process fluid is plugged or blocked off, only a low pressure was created during the output stroke. That is, the pressure in the pumping chamber 106 was, for example, 14 psia and goes to 10 psia as it did in FIG. 3(*a*). The suction, however, quickly increases the vacuum so that pressure in the pumping chamber 106 drops further to, for example, 3 psia as shown in FIG. 4(*b*). The diaphragm 34 and plunger 42 stay too far left keeping valve port 98 closed and bias spring 96 somewhat compressed. There is only momentary oil flow through check valves 32, valve port 98 and the various passageways in stem 82.

At mid-stroke of the suction stroke as shown in FIG. 4(*b*), any diaphragm movement right causes a higher vacuum in pumping chamber 106 which tends to hold diaphragm 34 and plunger 42 to the left, while piston 46 moves to the right. Valve port 98 is shut off, but nevertheless because of the lower pressure, for example, 6 psia, being developed in transfer chamber 44, there is oil leakage due to the tolerances in the system from the reservoir (not shown) to transfer chamber 44. The weak bias spring 96 in the conventional diaphragm pump allows plunger 42, and particularly valve spool 84, to stay too far left and allow the lower pressure in transfer chamber 44 to develop and continue.

As shown in FIG. 4(*c*), at the end of the intake or suction stroke, the plunger 42 and diaphragm 34 remain too far left, and the low pressure in transfer chamber 44 continues to cause leakage and after many strokes like this, transfer chamber 44 gets overfilled with oil prior to starting the output stroke.

The configuration at the beginning of the output stroke is shown in FIG. 4(*d*). Piston 46 starts to move left. Since there is low pressure in the pumping chamber 106, pressure does not build in transfer chamber 44 until later in the output stroke.

As shown at mid-stroke in FIG. 4(*e*), the overfilled oil transfer chamber 44 moves diaphragm 34 and valve spool 84 to the left at the same rate. When base plate 88 and diaphragm 34 approach wall 108 on the pumping side of the pump, pressure finally rises in transfer chamber 44. The short time in which there is pressure greater than 14.7 psia, which is the pressure in the reservoir, is not enough time to allow oil leakage back from transfer chamber 44 to the reservoir to balance flow leakage during the suction stroke. Hence, the diaphragm 34 distorts due to the oil overfilling in transfer chamber 44. The weak spring 96 is compressed.

The end of the output stroke is shown in FIG. 4(*f*). Overfilled transfer chamber 44 pushes base plate 88 fully against wall 108 and diaphragm 34 stretches into the port of outlet check valve assembly 37. A rapid rise in pressure in transfer chamber 44 at this time eventually causes diaphragm 34 to either cut on various surfaces it encounters or to burst. At this point, the pump fails. As a result, there can be contamination of process fluid remnants into piston assembly 30 and contamination of oil into the process fluid line.

Thus, when a high vacuum (that is, a plugged filter or inlet valve shut off) exists on the pumping chamber side of the diaphragm, the diaphragm does not want to move with the piston. This would not ordinarily cause a problem, as the valve spool 84 and valve port 98 close. If this condition exists, however, for a long period of time, the leakage between the valve spool and the valve port plus the leakage between the piston and the housing combine to allow oil overfill in the transfer chamber. On the output stroke, the pressure must be high enough to re-expel leakage volume. It can expel, however, only around the piston and housing since the ball check valves 32 prevent any exiting through the valve port. Since the pump inlet is blocked and unable to pump much process fluid volume, pressure during process fluid outlet is low and/or only for part of the stroke. Empirically, it has been found that the outlet pressure must be more than 100 psig in order to "leak as much out as in". If the pump does not leak as much out of the transfer chamber as it leaks in, then the added volume is powered by the drive piston until the diaphragm balloons and enters ports or crevices and causes rupture.

SUMMARY OF THE INVENTION

The present invention is directed to a diaphragm pump which receives drive power from a motor. The pump has a housing which houses a pumping chamber adapted to contain fluid to be pumped (process fluid), a transfer chamber adapted to contain hydraulic fluid (oil), and a hydraulic fluid reservoir. The pump has a diaphragm having a transfer chamber side and a pumping chamber side. The diaphragm is supported by the housing and is disposed between the pumping chamber and the transfer chamber and is adapted for reciprocation toward and away from the pumping chamber. The pump has a piston in a cylinder in the housing adapted for reciprocation of the diaphragm between a power stroke and a suction stroke.

A fluid communication path for the hydraulic fluid is formed between the hydraulic fluid reservoir and the transfer chamber. A valve in the fluid communication path allows selectively flow of hydraulic fluid from the hydraulic fluid reservoir to the transfer chamber when the valve is open.

An overfill preventive element is provided for the transfer chamber. The overfill preventive element protects the diaphragm from being deformed beyond a design limit due to the transfer chamber being filled beyond a maximum fill condition to an overfill condition.

In one embodiment, the fluid communication path is a first fluid communication path and the valve includes an inlet valve. The overfill preventive element includes a second fluid communication path for the hydraulic fluid between the transfer chamber and the hydraulic fluid reservoir and further includes an outlet valve in the second communication path for selective by allowing flow of hydraulic fluid from the transfer chamber to the hydraulic fluid reservoir when the outlet valve is open.

In another embodiment, the valve includes a valve spool. The valve spool is movably connected to the piston and the diaphragm. The overflow preventive element includes the piston having a mechanical stop for the valve spool, so that the transfer chamber cannot reach an overfill condition which could result in the diaphragm being deformed beyond a design limit.

In a further embodiment, the diaphragm pump includes a spring which urges the diaphragm away from the pumping chamber such that the first end of the spring is connected with the diaphragm and the second end of the spring is supported by the piston for movement with the piston. The overfill preventive element is formed by the spring when it is properly sized to be completely closed just before the transfer chamber reaches the maximum fill condition.

The present invention maintains the biased oil drive as described in U.S. Pat. No. 3,775,030. The present invention, however, discloses use of an overfill preventive element. In this way, at high vacuum conditions, the overfill preventive element overcomes suction forces in the pumping chamber and prevents oil overfill in the transfer chamber (so the diaphragm does not fail). Thus, the improvements disclosed herein optimize durability and efficiency for a diaphragm pump.

DETAILED DESCRIPTION OF THE PREFERRED EMBODIMENT

The present invention is an improvement to the conventional diaphragm pump described above. Like parts are designated by like numerals throughout the Figures. Improved parts are distinguished and described. It is understood that the improved parts lead to a synergistic improvement of pump performance and durability.

It is necessary to solve the problem of transfer chamber 44 overfilling so that at the end of a power stroke it is not likely that diaphragm 34 would be expanded to the point of rupture.

Figure 5:
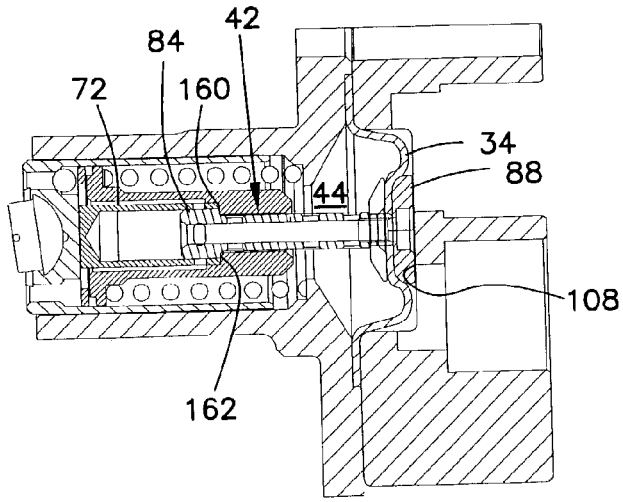
FIG. 5 is a partial cross-sectional view of a diaphragm pump in accordance with the present invention having a mechanical stop as an overfill preventive element.

As depicted in FIG. 5, one possibility in accordance with the present invention is to eliminate bias spring 96, and rather introduce a mechanical stop 160 for valve spool 84. By limiting the travel of valve spool 84, the travel or expansion of diaphragm 34 is also limited. That is, the entire plunger 42, as well as diaphragm 34, is limited in travel during the power stroke as a result of valve spool 84 being stopped by mechanical stop 160. Since bias spring 96 has been eliminated, the space which it otherwise occupied is also eliminated so that base section 58 extends inwardly to near stem 82. The mechanical stop 160 is formed as a shoulder in base section 58 at the desired location. Shoulder 162 of valve spool 84 contacts mechanical stop 160 at the design end of the power stroke to stop plunger 42 and diaphragm 34.

With reference to FIG. 5, the farthest right in the figure that mechanical stop 160 can be located is the position just before base plate 88 contacts wall 108 at the same time as shoulder 162 contacts mechanical stop 160. The point of contact would be the maximum fill condition for transfer chamber 44, compared to an overfill condition which would be any greater volume for transfer chamber 44 than the indicated maximum fill condition. Diaphragm 34 has a design limit for which it does not rupture for fill conditions of transfer chamber 44 less than the maximum fill condition.

Although the use of a mechanical stop can eliminate the need for bias spring 96, there is still advantage to using a bias spring stiff enough to stop the fill of hydraulic fluid in transfer chamber 44 before it reaches the maximum fill condition. The advantage of using bias spring 96 is that the equilibrium pressure can be reached without coming to a hard contact with the mechanical stop which gives an abrupt jump in pressure. With a high-speed pump like a diaphragm pump, repeated contact with a mechanical stop is a potential source of noise and fatigue. The presence of bias spring 96 further provides a small pressure bias during normal operation as has been determined to be useful in conventional pumps as discussed hereinbefore.

Figure 6:
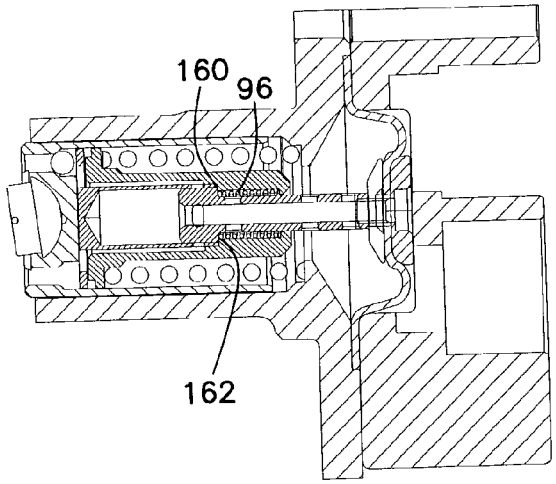
FIG. 6 is a partial cross-sectional view of a diaphragm pump in accordance with the present invention having a mechanical stop with a bias spring.

As shown in FIG. 6, mechanical stop 160 is used in conjunction with bias spring 96. With this structure, mechanical stop 160 is still the overfill preventive element, but bias spring 96 provides a pressure bias during normal operation and also helps to cushion valve spool 84 as shoulder 162 approaches mechanical stop 160. In this regard, a stiff bias spring is advantageous relative to a weak bias spring.

A design configuration wherein a pump in accordance with the present invention has a stiff bias spring 126, as distinguished from a weak bias spring 96, is described with respect to FIGS. 7(A)–(F). A weak bias spring 96 of a conventional pump is distinguished from a stiff bias spring 126 in FIG. 8.

Figure 8:
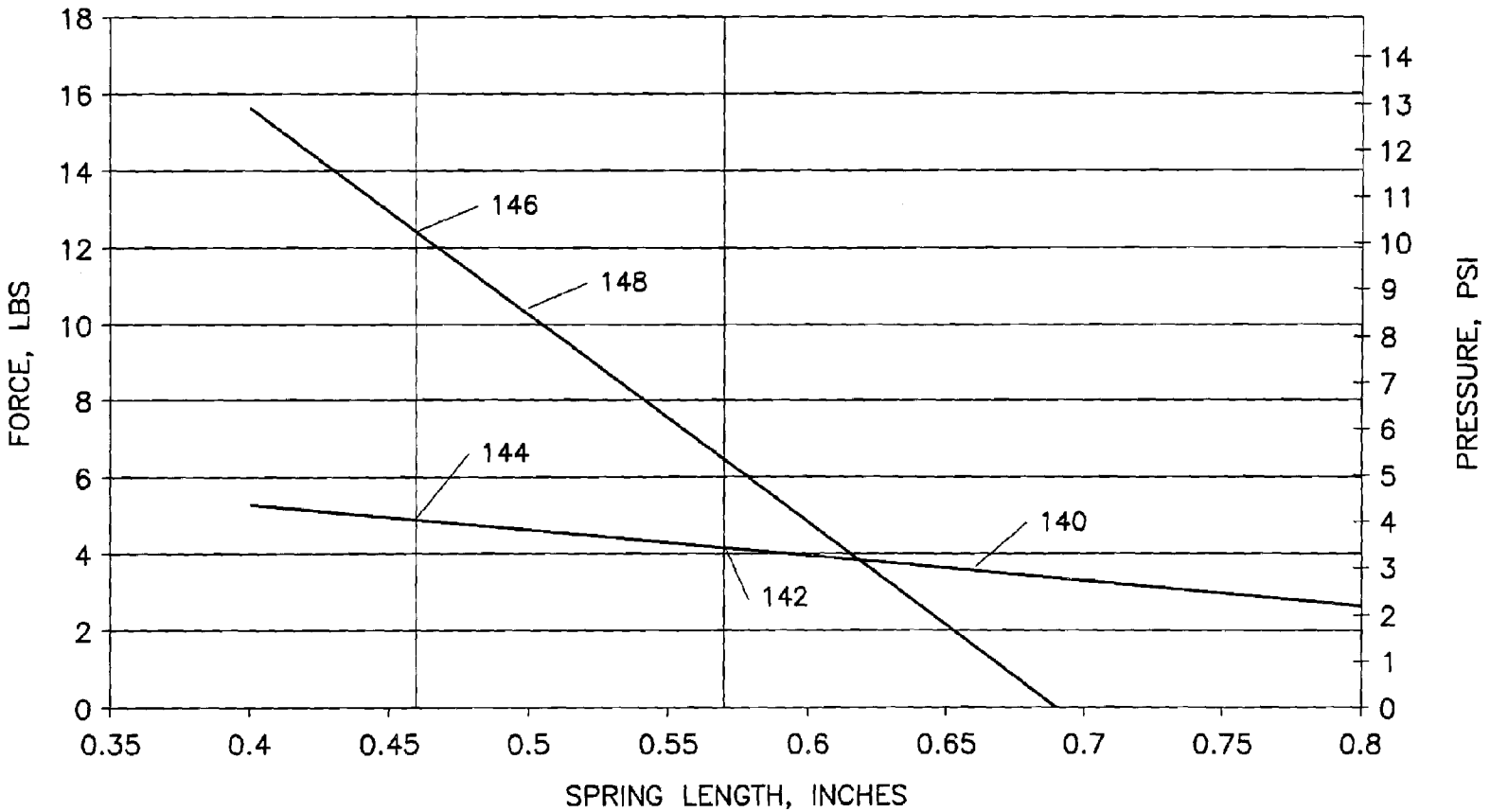
FIG. 8 is a graph illustrating a weak conventional bias spring and a strong bias spring in accordance with the present invention.

FIG. 8 is a graph which shows spring length in inches along the X-axis. On the left side along the Y-axis, the graph is calibrated for force in pounds which the piston exerts on the diaphragm. Along the right side for the Y-axis, an effective pressure at the diaphragm in pounds per square inch (psi) is provided. In the conventional pump, it is known from U.S. Pat. No. 3,775,030 that a small over-pressure, for example, 3 psi, should be provided in the transfer chamber 44 in order for the pump to work properly under normal conditions. As a consequence, the conventional pump has had a weak spring so that the over-pressure maintained by the bias spring does not differ too greatly from 3 psi for various spring lengths during the compression of normal operation. A spring constant for a typical spring is shown as line 140 in FIG. 8. However, as discussed above with respect to FIGS. 4(*a*)–4(*f*) the conventional pump has the problem of the diaphragm 34 failing if the line providing process fluid to the pump becomes plugged, such as when a filter gets dirty. Thus, with respect to improving the pump, two reference points were considered. A first reference point occurs when valve port 98 in FIG. 2 just turns off or is closed. At the point at which valve port 98 just turns off, the bias spring should counteract fluid suction on the fluid pumping side adequately to prevent the suction from holding the diaphragm to that side and thereby allowing unwanted oil to fill into the transfer chamber. The minimum, of course, is zero since clearly a negative pressure would constantly call for more oil in the transfer chamber and be undesirable. Experience with the conventional pump as discussed above has shown that 3 psi works well. Greater pressure, up to 8 psi or so, is acceptable. Therefore, a range of zero–8 psi is appropriate. Reference point 1 is shown at numeral 142 in FIG. 8.

The second reference point occurs when transfer chamber 44 has filled with oil to the maximum fill condition, that is, when base plate 88 contacts wall 108 as shown in FIG. 4(*f*). The second reference point is shown at numeral 144. For weak spring 140, the pressure at valve shut off reference point 142 is slightly greater than 3 psi and at maximum fill condition 144 the pressure is about 4 psi. Conventionally, this has been the design for bias spring 96. In order to solve the problems discussed herein before for a high vacuum condition in the pumping chamber of the pump, however, it was determined that it was necessary to approximately satisfy reference point 1 with respect to normal operating conditions, and with respect to the condition of high vacuum, it was determined that the spring should provide a pressure in transfer chamber 44 of about 10.5 psi as shown at numeral 146 in FIG. 8, which does not allow a large pressure differential between the reservoir and the transfer chamber and cushions shoulder 162 as it approaches mechanical stop 160. The reservoir is atmospheric, or essentially 14.7 psi. These two reference points when connected by a straight line which then determines the spring constant for the improved pump.

FIGS. 7(*a*)–(*f*) illustrate operation with respect to a stiff spring of the type represented by line 148 in FIG. 8.

FIGS. 7(*a*)–(*f*) assume the stiff bias spring and a vacuum condition, that is, a plugged process line. FIGS. 7(*a*)–(*f*) are similar to FIGS. 4(*a*)–4(*f*), except the weak bias spring is replaced by the stiff bias spring.

In FIG. 7(*a*), the suction stroke begins. Since the inlet for the process fluid is blocked off, no pressure was created on the output stroke so that suction on the suction stroke quickly brings a vacuum condition in the pumping chamber 106. The diaphragm 34 and plunger 42 stay too far left and close port 98 and compress somewhat bias spring 97.

With reference to FIG. 7(*b*), a configuration at mid-stroke is shown. The lower pressure in pumping chamber 106 which then causes a lower pressure in transfer chamber 44 holds diaphragm 34 and plunger 42 to the left but cannot hold them as far left as in the conventional pump as shown in FIG. 4(*b*), because of the stiff bias spring 97 with the higher spring constant. Overfill of transfer chamber 44 is consequently limited to the volume of stretch of diaphragm 34 under these conditions.

The suction stroke reaches its end in FIG. 7(*c*) at bottom dead center. The high suction in the pumping chamber is still present, but the stiff spring (see reference point 146 in FIG. 8) counterbalances the suction force thereby raising the pressure in transfer chamber 44 and preventing overfilling of transfer chamber 44 prior to starting the output stroke. For example, in a preferred case, the differential pressure in the transfer chamber versus the pumping chamber is about 10.5 psi for the bias spring to counterbalance.

The output stroke begins as shown in FIG. 7(*d*). Piston 46 moves to the left since there is very low pressure in the pumping chamber. Pressure does not build in the transfer chamber except as caused by the stiff bias spring 97, so diaphragm 34, plunger 42, and piston 46 continue to move together.

At mid-stroke as shown in FIG. 7(*e*), check valves 102 stay closed and the stiff spring 97 biases to cause leakage out of the transfer chamber rather than into it.

The output stroke continues to finish as shown in FIG. 7(*f*). Since transfer chamber 44 has not overfilled, diaphragm 34 does not balloon and normal operation continues in spite of the plugged inlet line to the pumping chamber. Hence, the stiff bias spring 97 and mechanical stop 160 prevent the failure mode described with respect to FIGS. 4(*a*)–4(*f*).

Thus, once the valve spool moves past the shut off port, the stiff bias spring prevents it from moving much further. As shown in FIG. 8, at the normal port shutoff position (reference point 1), both the weaker spring and the stiffer spring have a force of just over 4 pounds, or about 3.5–4.5 psi pressure on the diaphragm. Thus, the positive oil drive bias of U.S. Pat. No. 3,775,030 is maintained. Now, however, as travel is continued towards the maximum spring compression, the stiff spring has over 12 pounds of force versus only about 5 pounds of force for the weak spring. The added force limits the ability of the diaphragm to move too far under high vacuum conditions. This is true because the pull from the oil transfer chamber side is now the spring force plus the pressure differential between the pumping chamber and the transfer chamber. The conventional weak spring could only effectively counteract about 5 psi of vacuum; the improved stiff spring is optimized at counteracting about 10.5 psi of vacuum, which is all that is practically attainable (although theoretically, 14.7 psi could be obtained). Although designing for the highest force possible would assure that oil never is pushed into a full transfer chamber, it is only necessary that there is not a net increase in oil during a full suction and output cycle of the pump. In other words, as long as there is more time during the suction and output strokes where the hydraulic transfer chamber is above atmospheric pressure than below, there will be no average increase of oil in the chamber.

Vacuum diaphragm rupture testing was done. Test results are shown in Table 1. A pump as described in FIG. 2 was used modified to have stiffer spring constants for bias spring 97 as shown in Table 1. A vacuum was maintained at the inlet (check valve 36). The vacuum was maintained at 15 in. Hg or less for a few hours and then was increased to 20 in. Hg or greater until failure or until the test was stopped.

TABLE 1

| Test | Ser. No. | K | Run Time | Outcome |
|---|---|---|---|---|
| 1 | 141849 | 43.1 lb/in | 97 hr | Rupture |
| 2 | 141849 | 43.1 | 55 | Rupture |
| Comment: Burr found; valve housing interior deburred | | | | |
| 3 | 141849 | 43.1 | 106 | Rupture |
| 4 | 142132 | 53.7 | 106 | OK |
| 5 | ? | 53.7 | 124 | OK |
| 6 | 142131 | 53.7 | 214 | OK |

The first three tests were run with a stiff spring having a spring constant of 43.1 lb/in. The diaphragm ruptured at 97 hr. during the first test and at 55 hr. during the second test. After the second test, the pump was examined and a burr was found in the valve housing so that valve spool 84 was sticking so that eventually the diaphragm ballooned and got caught on base plate 90. The valve housing was deburred and test 3 was run. The diaphragm ruptured at 106 hr. It was determined that the burr was not material to the findings except for time to failure. The 43.1 lb/in rated spring allowed failure to occur at about 100 hours.

Tests 4–6 were run using a bias spring having a spring constant of 53.7 lb/in. In each test, the pump ran for over 100 hr. and for Test 6, the pump ran for over 200 hr. without diaphragm rupture.

Figure 9:
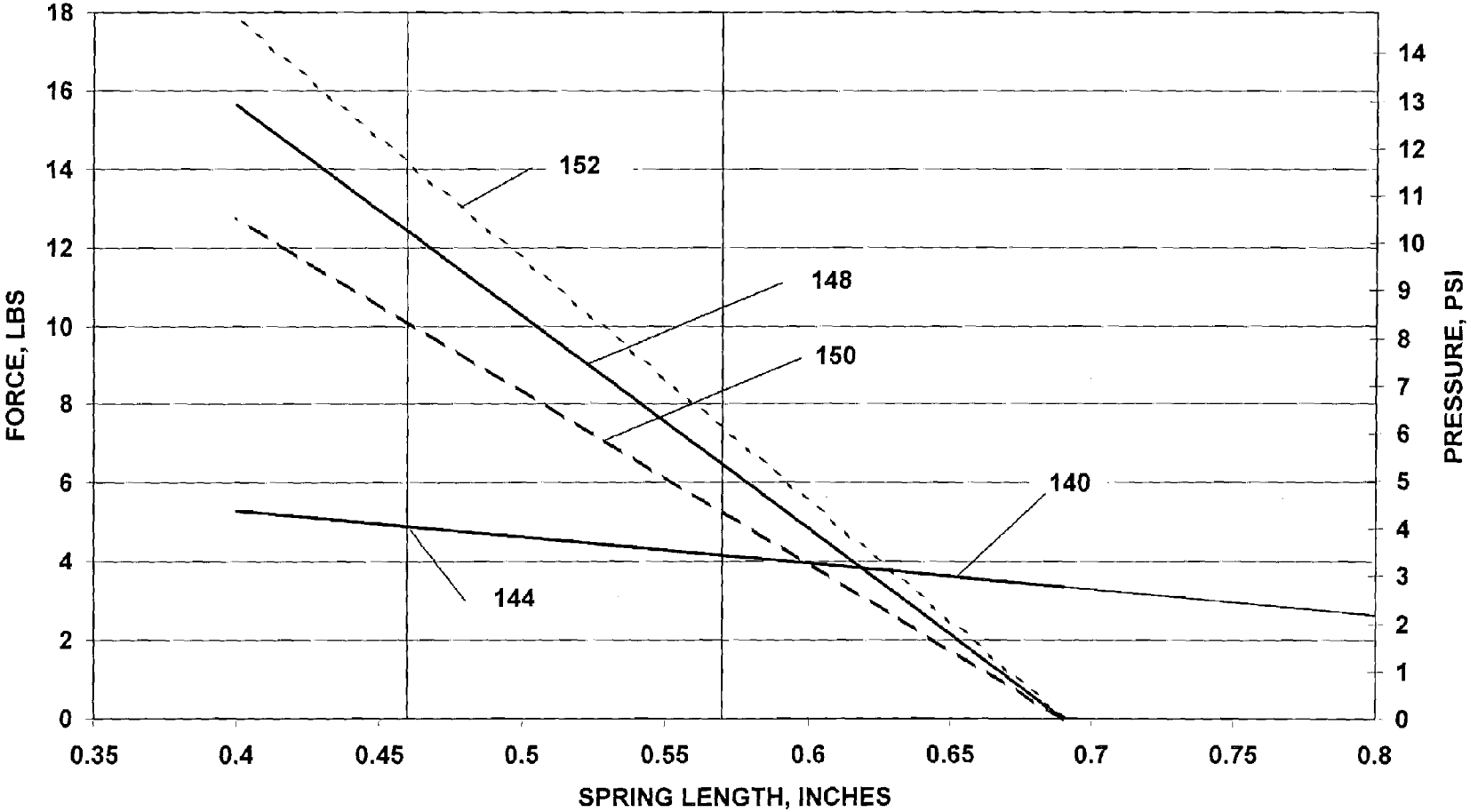
FIG. 9 is a graph which illustrates a range of spring constants for bias springs in accordance with the present invention.

It was determined from the testing that the bias spring having the spring constant of 43.1 lb/in. was marginally acceptable. Clearly the pump having the bias spring with spring constant 53.7 lb/in. was acceptable since there were no failures. The conclusions of the testing are shown in FIG. 9. Line 150 shows the bias spring having spring constant of 43.1 lb/in. Line 148 shows the bias spring having spring constant of 53.7 lb/in. Broken line 152 represents a bias spring having a spring constant which would be the maximum ever needed. That is, the maximum vacuum which could be achieved at reference point 2, the point at which base plate 88 contacts wall 108 (see FIG. 4(*e*)) is 14.7 psia. A pump like this could never achieve such a vacuum. Therefore, line 152 is shown as being broken and somewhat approximate. In any case, it gives the general idea of where a maximum spring constant would be.

For a particular pump, the spring constant can be calculated in the following way assuming the following design assumptions. First, the diaphragm's equivalent area at mid-stroke is approximately the same as the piston area. Second, the minimum pressure differential across the diaphragm needed must be equal to the suction pressure the pump is designed for. Third, the maximum pressure differential is 14.7 psi. Based on that, the following statements can be made:

1. Overfill distance is the difference in distance between the diaphragm and the piston at (i) maximum overfill position and (ii) neutral position (valve just closed).
2. Overfill spring force is design suction pressure differential times the piston area.
3. Neutral spring force is the neutral operating pressure differential times the piston area.
4. Spring constant is the quantity of overfill spring force minus neutral spring force divided by the overfill distance.

Based on these assumptions and statements, spring constant can be calculated from:

$$k=A_p(P_s-P_n)/d_0$$

where k is spring constant, $A_p$ is piston area, $d_0$ is overfill distance, $P_s$ is design suction pressure differential, $P_n$ is neutral operating pressure differential.

Based on the testing discussed above, appropriate maximum design suction pressure differential is 8.4–14.7 psi. Appropriate neutral operating pressure differential is zero to 8 psi.

It is noted from FIGS. 8 and 9 that the stiffer bias spring of the present invention is necessarily shorter than the conventional spring. This has a good benefit in that when the pump is shut-down, the bias spring does not continually force oil out of the transfer chamber and past the piston assembly/housing interface to the reservoir. With the stiffer spring, once the transfer chamber has properly filled and the pump is turned-off, the spring no longer exerts a significant force. That means the transfer chamber has an oil fill which is at its proper pumping point, and it does not have to refill at the next start-up.

Figure 10:
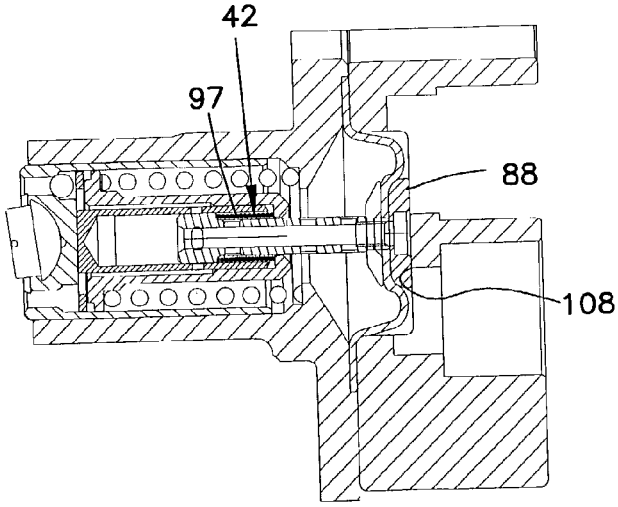
FIG. 10 is a partial cross-sectional view of a diaphragm pump having a bias spring designed to reach solid height at maximum fill position to function as an overfill preventive element in accordance with the present invention.
Figure 7A:
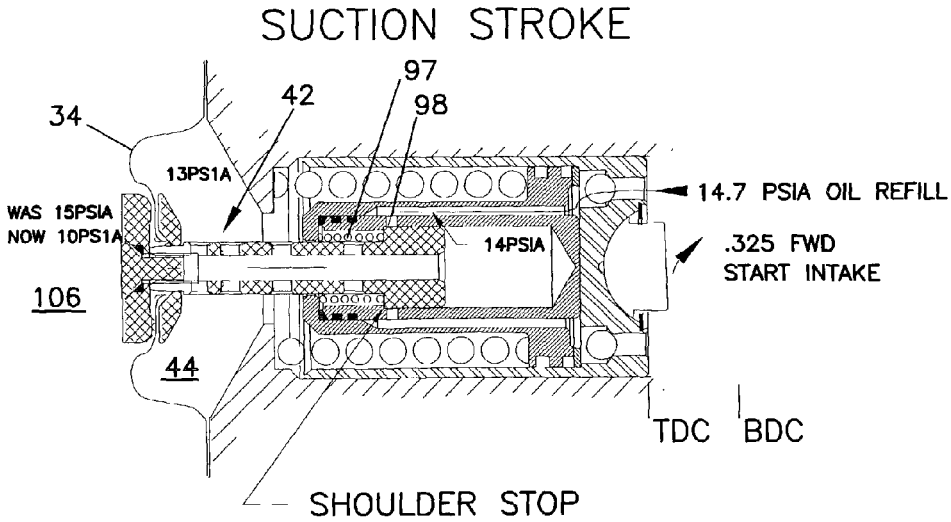
FIGS. 7(*a*)–7(*f*) are partial cross-sectional views of a diaphragm pump illustrating operation of the present invention with mechanical stop and a high spring constant bias spring.
Figure 7B:
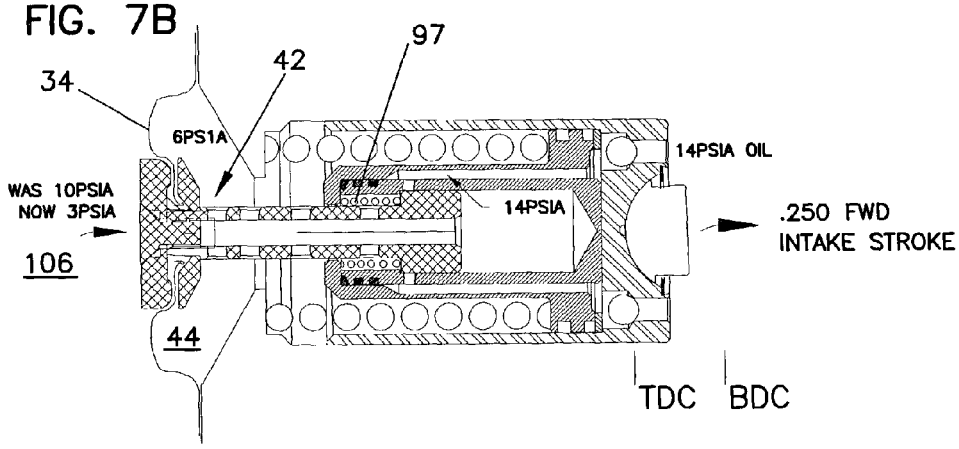
Figure 7C:
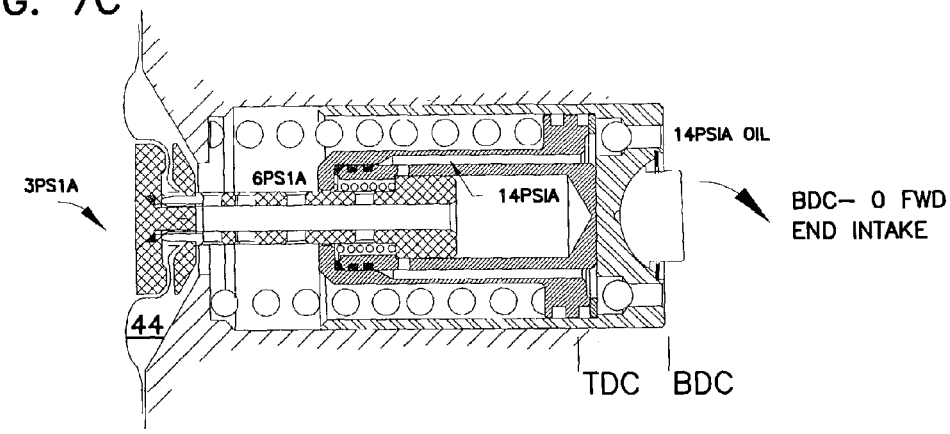

With a stiffer and shorter bias spring 97, it is further possible to size the spring so that it will reach solid height at the maximum fill position of transfer chamber 44. As shown in FIG. 10, bias spring 97 is solid when base plate 88 contacts wall 108, i.e., when transfer chamber 44 reaches the maximum fill condition. As indicated earlier, preferably spring 97 goes solid at a point before base plate 88 reaches wall 108. Also note that as shown in FIG. 10, there is no need for mechanical stop 160. Thus, spring 97 compresses and eventually reaches its solid height thereby stopping further movement to the right in FIG. 10 of plunger 42. With this structure, bias spring 97 is an overfill preventive element.

Figure 1:
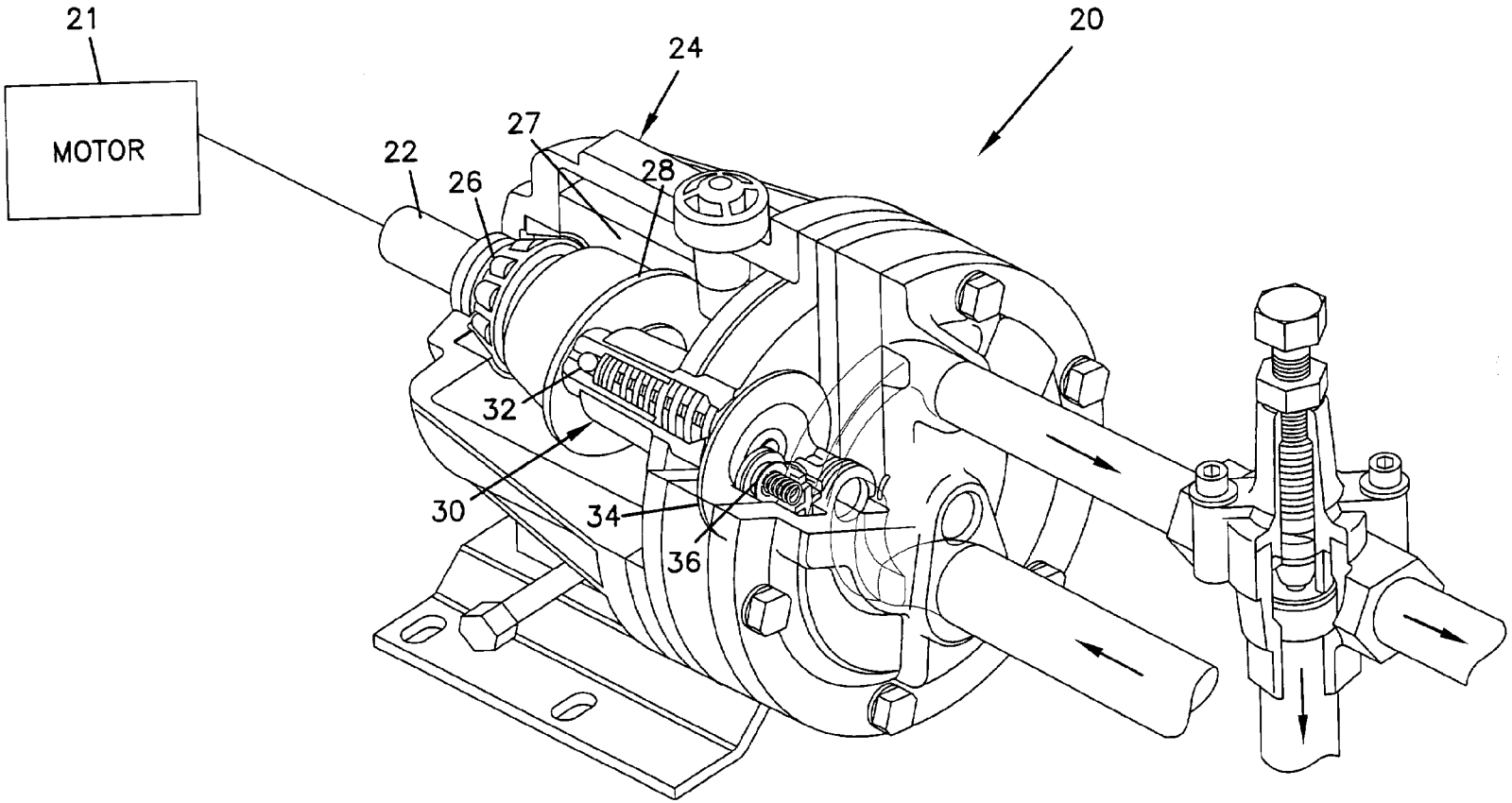
FIG. 1 (PRIOR ART)
FIG. 1 is a perspective view of a conventional diaphragm pump.
Figure 2:
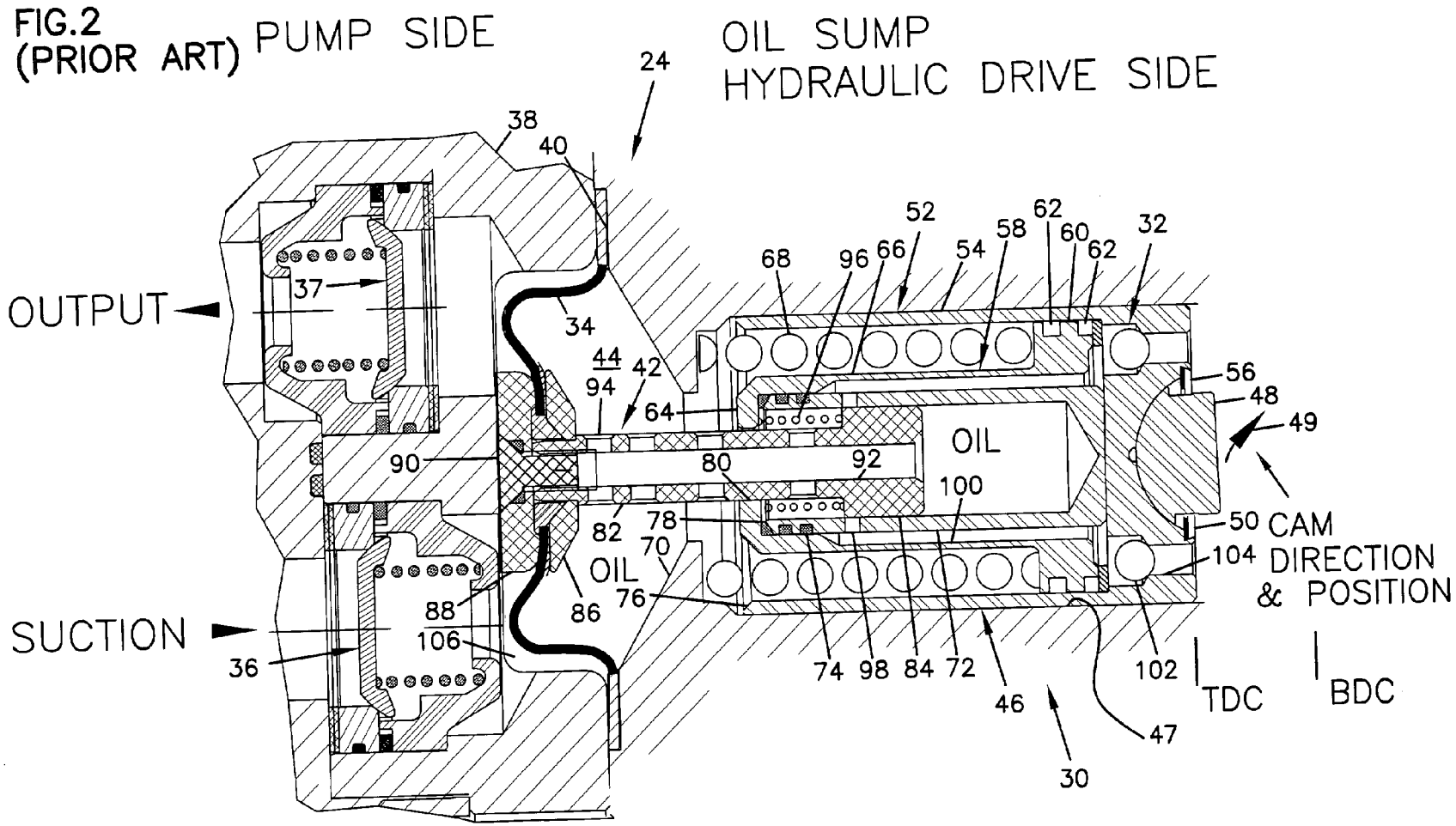
FIG.2 (PRIOR ART)
FIG. 2 is a partial cross-sectional view of a conventional diaphragm pump.

The diaphragm pump discussed above having various alternatives for an overfill preventive element all included a fluid communication path for hydraulic fluid between the hydraulic fluid reservoir and the transfer chamber with a valve in the communication path for selectively allowing flow of hydraulic fluid from the hydraulic fluid reservoir to the transfer chamber when the valve is open. With reference to FIG. 2, the fluid communication path extends from the hydraulic fluid reservoir (not shown) through check valve 32 and then through the spool valve which includes valve port 98 and valve spool 84, to transfer chamber 44 which includes the space on the diaphragm side of the spool valve. This communication path with these valves allow and control flow of oil into transfer chamber 44. As discussed with reference to FIGS. 3(*a*)–(*f*), in normal operating conditions control of oil coming in maintains a relatively constant volume in the transfer chamber and the pump works well. As discussed above, however, there are certain conditions which cause this type of valving to lose control of volume in the transfer chamber. The most common condition is excessive suction at the pump inlet as discussed with reference to FIGS. 4(*a*)–(*f*). Alternatives with respect to overfill preventive elements for this type of structure to address this problem were discussed above. A further alternative for an overfill preventive element is to provide an oil control valve system that not only controls flow of oil into the transfer chamber, but also releases excess oil from the transfer chamber. Such system is shown in FIG. 11.

Figure 11:
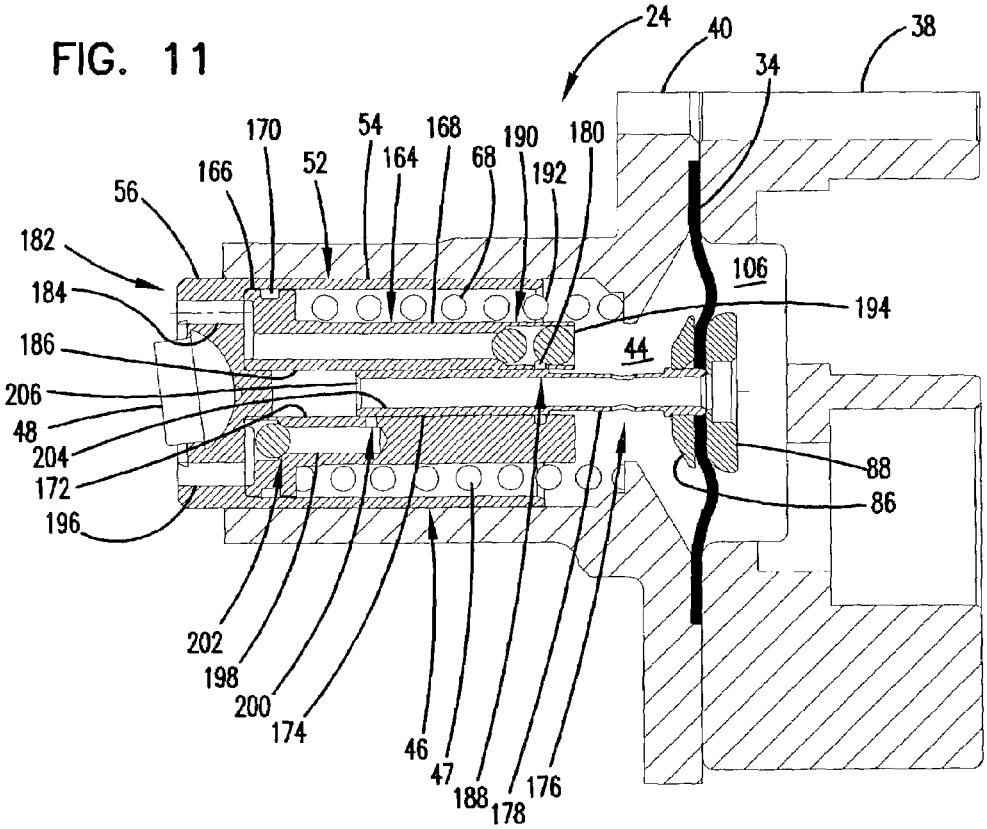
FIG. 11 is a partial cross-sectional view of a diaphragm pump illustrating a valve system functioning as an overfill preventive element in accordance with the present invention.

The pump depicted in FIG. 11 is the same as the pump of FIG. 2, except with respect to the differences described. Portions 38 and 40 of housing 24 hold diaphragm 34 operably between them. Piston 46 reciprocally moves in cylinder 47 due to the wobble plate (not shown) oscillating pad 48. Piston 46 has a sleeve section 52 which forms the outer wall of the piston. Sleeve section 52 includes a sleeve 54 and an end portion 56 at the end having pad 48 which is in contact with the wobble plate.

Base section 164 is contained within sleeve section 52. Base section 164 of FIG. 11 is distinguished from base section 58 of FIG. 2. Further, in the pump of FIG. 11, there is no valve housing 72 and bias spring 97.

Base section 164 includes a base portion 166 and a cylindrical portion 168. Base portion 166 is in contact with end portion 56 of sleeve section 52 and includes one or more seal elements 170 for sealing between base portion 166 and sleeve 54. Cylindrical portion 168 extends beyond the open end of sleeve section 52 by a slight distance, but not so far that it would impact any part of portion 40 at the end of a power or output stroke. Cylindrical portion 168 forms a concentric space between it and sleeve 54 for piston return spring 68.

Base section 164 has a central, cylindrical opening 172 for receiving stem 174 of diaphragm plunger 176. Diaphragm 34 is held between head 86 and base plate 88 at the end of stem 174 opposite end portion 56. Stem 174 is hollow and has slots 178 which cooperate with port 180 as discussed further below. Transfer chamber 44 is formed on the piston side of diaphragm 34, and pumping chamber 106 is formed on the opposite side of diaphragm 34.

A valve system 182 is formed in piston assembly 30 to provide an overfill preventive element for transfer chamber 44. A passage 184 in end portion 56 is in fluid communication with a passage 186 in base section 164 to form a first communication path along with first inlet spool valve 188 and second inlet check valve 190 leading to transfer chamber 44.

First inlet spool valve 188 includes port 180 and slot 178 which also acts as an inlet port such that the two ports align when the valve is open and do not align when the valve is closed. In this regard, stem 174 functions as a valve spool.

Second inlet check valve 190 is a ball check valve which is open in the direction of flow from the hydraulic fluid reservoir to transfer chamber 44, and is closed in the direction of flow from transfer chamber 44 to the hydraulic fluid reservoir. Ball 192 is located near the end 194 of base section 164 which is opposite first base 166.

The second communication path includes passage 196 in end portion 66 and passage 198 in base section 164, the two passages being in fluid communication with one another. The second communication path also includes first outlet spool valve 200 and second outlet check valve 202. First outlet spool valve includes port 204. Port 204 interacts with stem 174 which functions as a valve spool so that when the end 206 of stem 174 travels rightward in FIG. 11 far enough to open port 204, then first outlet spool valve 200 is open. When stem 174 moves leftward so that it closes port 204, first outlet spool valve 200 is closed. Thus, end 206 of stem 174 is located relative to port 204 such that first outlet spool valve 200 functions appropriately within the valve system 182.

Second outlet check valve 202 is a ball check valve which is closed in the direction of fluid flow from the hydraulic fluid reservoir to transfer chamber 44 and is open in the direction of fluid flow from transfer chamber 44 to the hydraulic fluid reservoir. Second outlet check valve 202 has a ball 208 located near end portion 56 in passage 198.

Figure 3A:
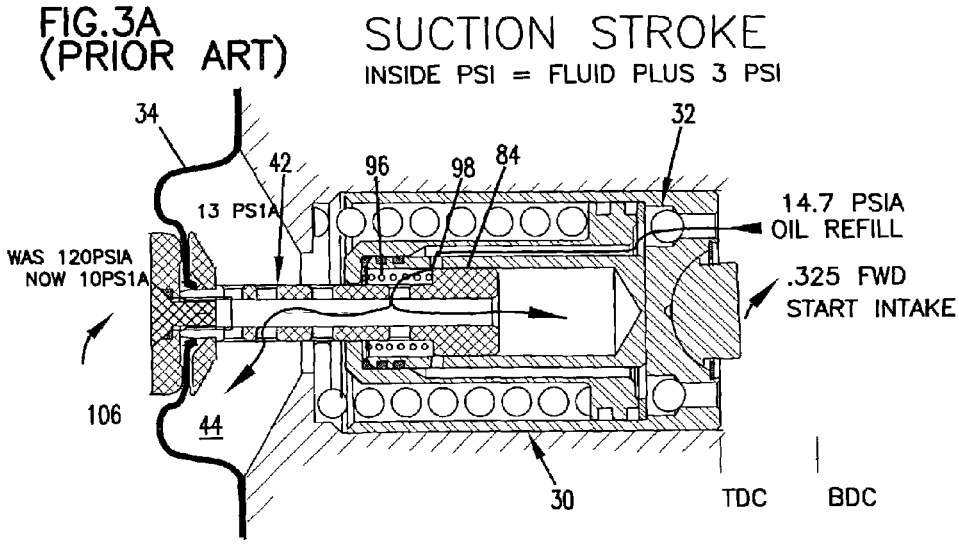
FIG.3A (PRIOR ART)
FIGS. 3(*a*)–3(*f*) are partial cross-sectional views of a conventional diaphragm pump illustrating normal conditions.
Figure 3B:
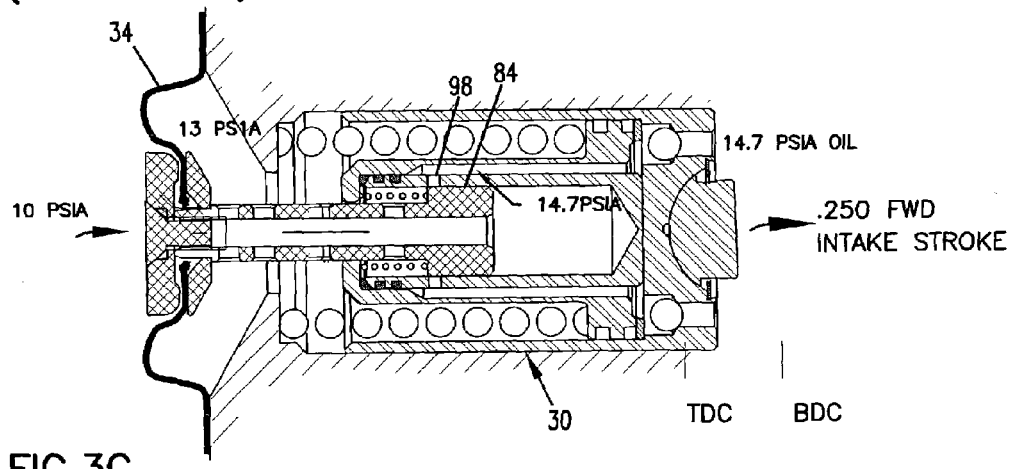
FIG.3B (PRIOR ART)
Figure 3C:
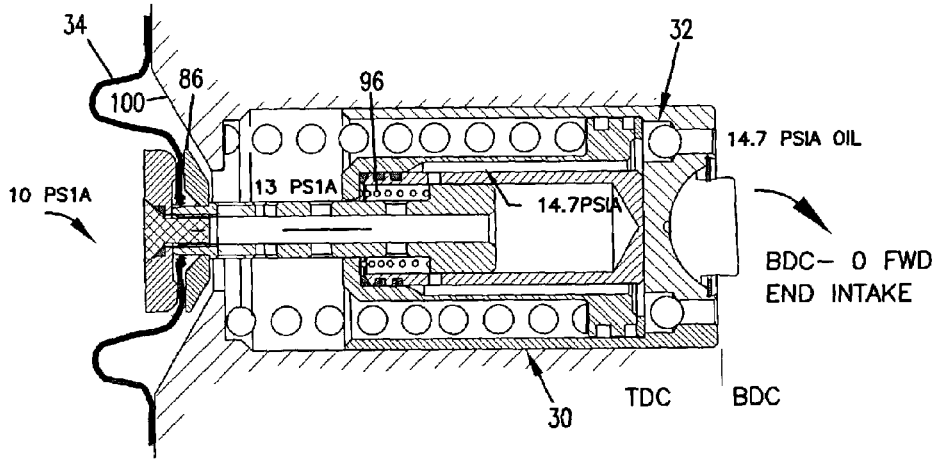
FIG.3C (PRIOR ART)
Figure 3D:
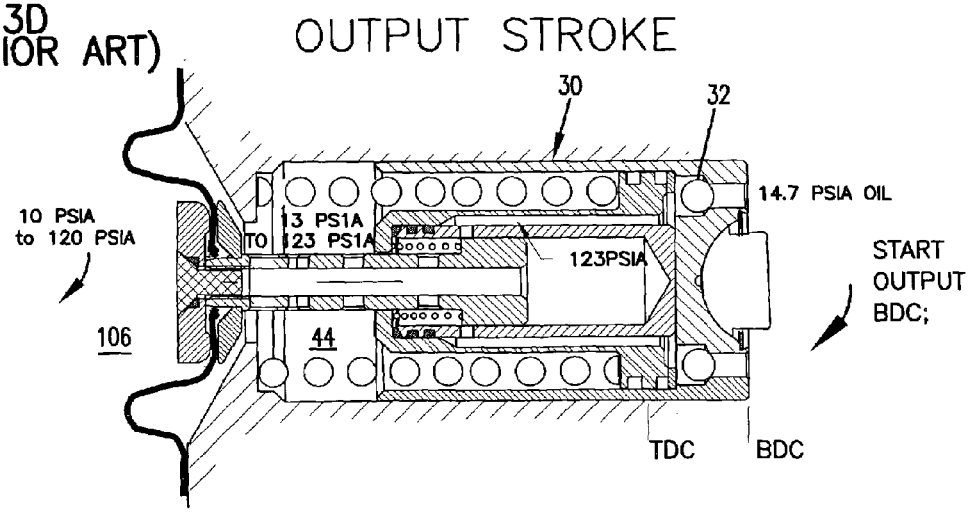
FIG.3D (PRIOR ART)
Figure 3E:
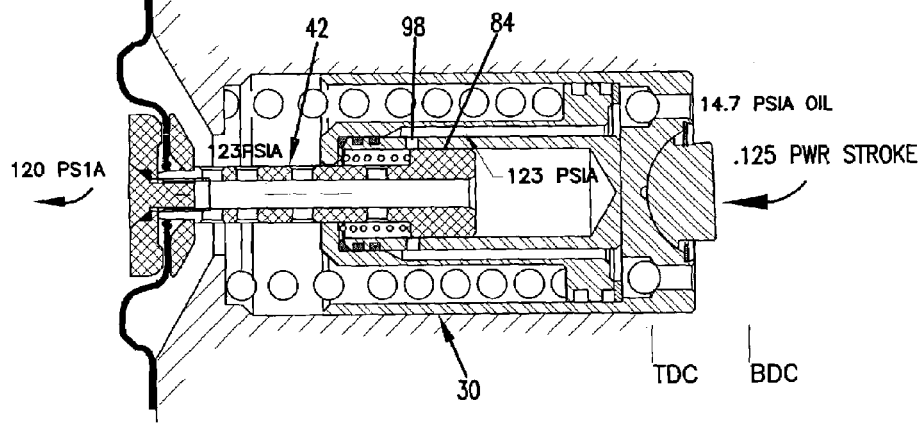
FIG.3E (PRIOR ART)
Figure 3F:
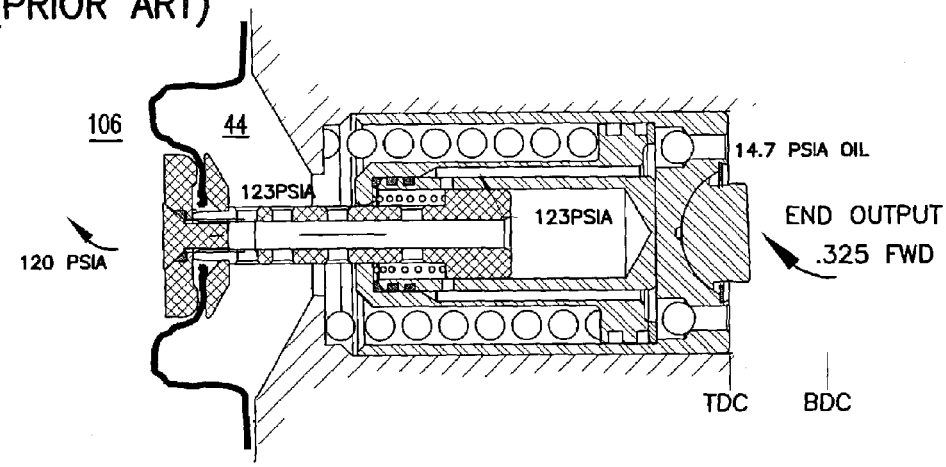
FIG.3F (PRIOR ART)
Figure 4A:
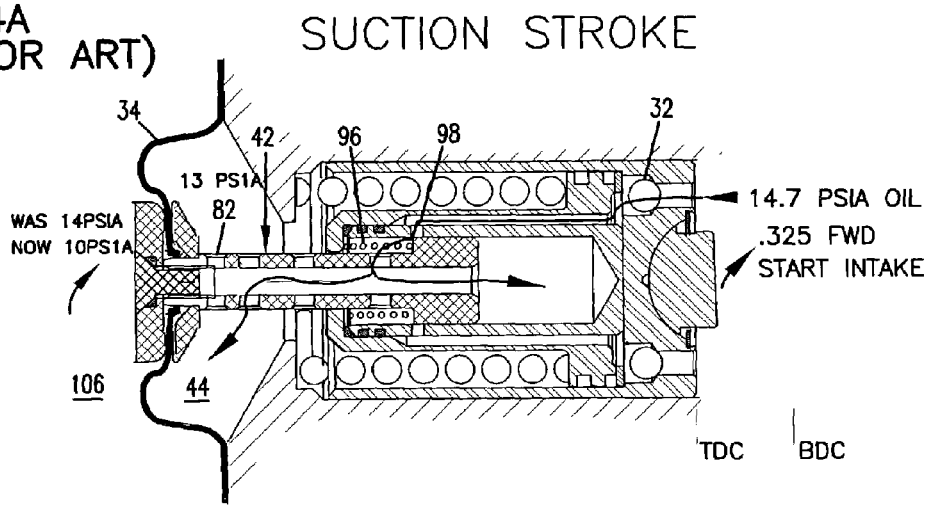
FIG.4A (PRIOR ART)
FIGS. 4(*a*)–4(*f*) are partial cross-sectional views of a conventional diaphragm pump illustrating a high vacuum condition resulting in diaphragm failure.
Figure 4B:
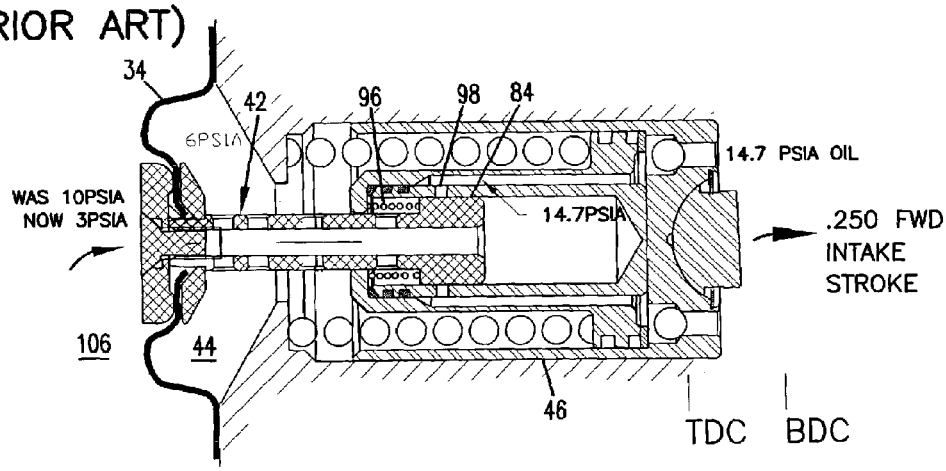
FIG.4B (PRIOR ART)
Figure 4C:
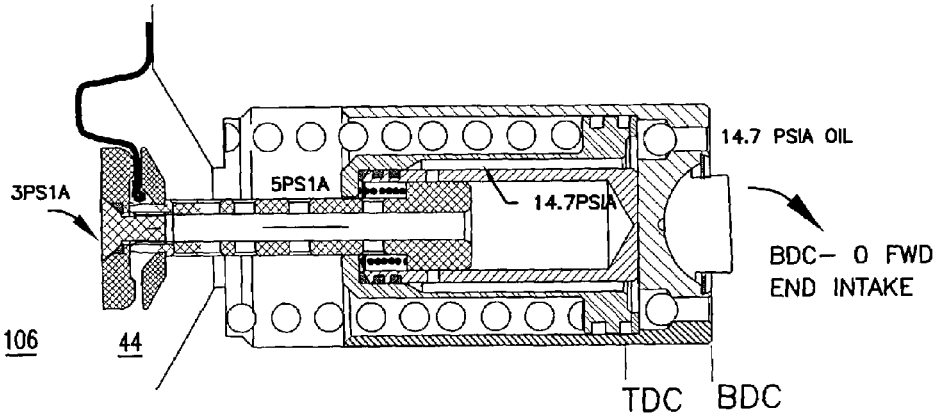
FIG.4C (PRIOR ART)
Figure 4D:
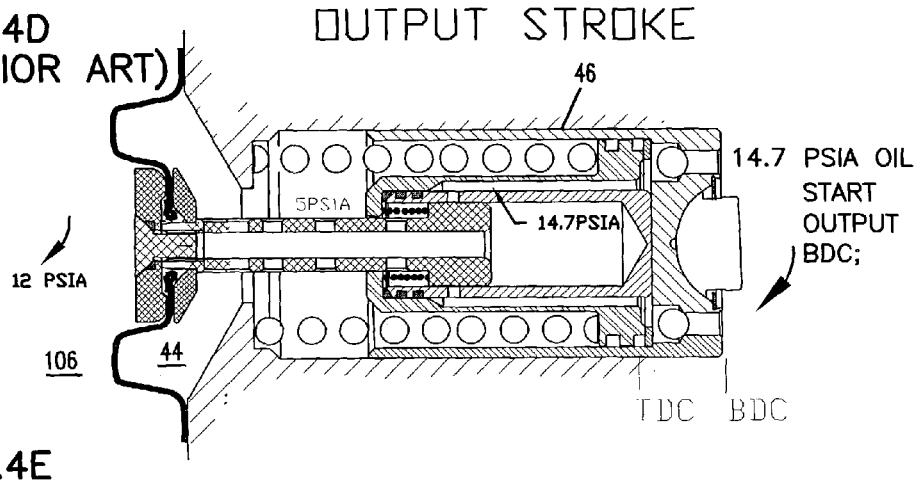
FIG.4D (PRIOR ART)
Figure 4E:
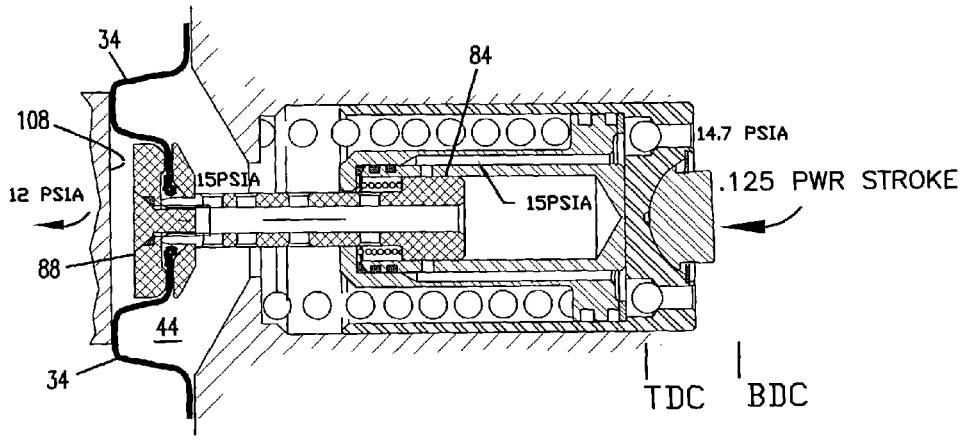
FIG.4E (PRIOR ART)
Figure 4F:
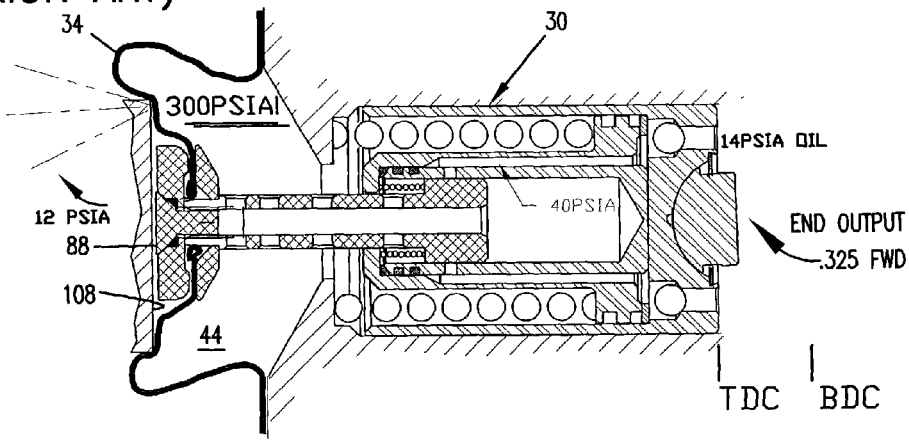
FIG.4F (PRIOR ART)
Figure 12:
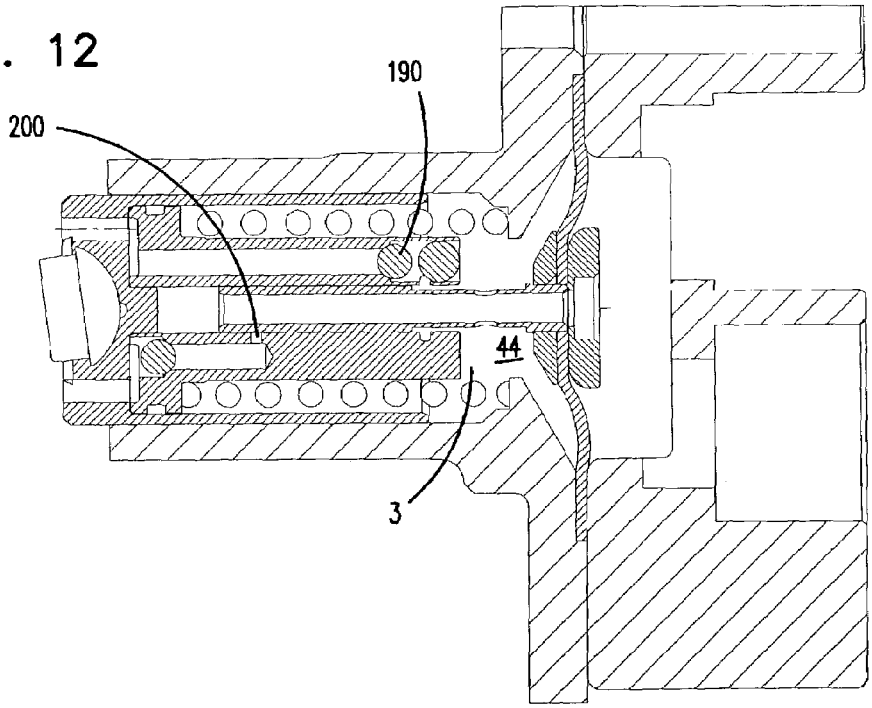
FIGS. 12–15 are partial cross-sectional views of a diaphragm pump illustrating operation of the pump of FIG. 11.

In operation, the functioning of valve system 182 is depicted in FIGS. 12–15, which correspond with FIGS. 3*b* and 3*e* of the depiction of the operation of a conventional pump. FIG. 12 shows the condition where there is too little hydraulic fluid in transfer chamber 44 and the pump is in a pressure stroke. Second inlet check valve 190 in the first communication path is closed on the inlet side and first outlet spool valve 200 is closed on the outlet side. Thus, no hydraulic fluid can leave transfer chamber 44. That is, since there is already too little hydraulic fluid in transfer chamber 44, the pressure stroke does not result in more hydraulic fluid being forced from transfer chamber 44 through the valve system.

Figure 13:
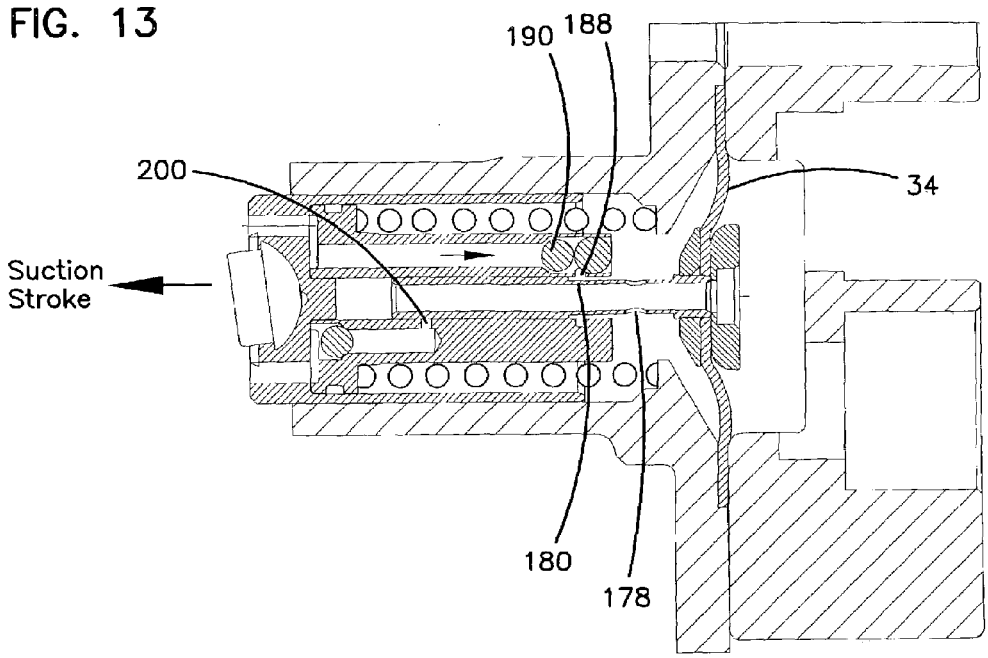

FIG. 13 shows the condition where there is too little hydraulic fluid in transfer chamber 44, and the pump is in the suction stroke. Second inlet check valve 190 is open because the pressure in transfer chamber 44 is below the pressure in the hydraulic fluid reservoir. The first inlet spool valve 188 is open because the lack of hydraulic fluid in transfer chamber 44 causes diaphragm 34 to move leftward in FIG. 13 so that stem 174 functioning as a valve spool is moved leftward and slot 178 functioning as a port aligns with port 180. Since both valves in the first communication path on the inlet side are open, oil flows into transfer chamber 44. Thus, no hydraulic fluid is lost during the pressure stroke (FIG. 12), and hydraulic fluid flows into the transfer chamber 44 during the suction stroke. Hence, the valve system functions to correct the situation of too little hydraulic fluid in transfer chamber 44.

Figure 14:
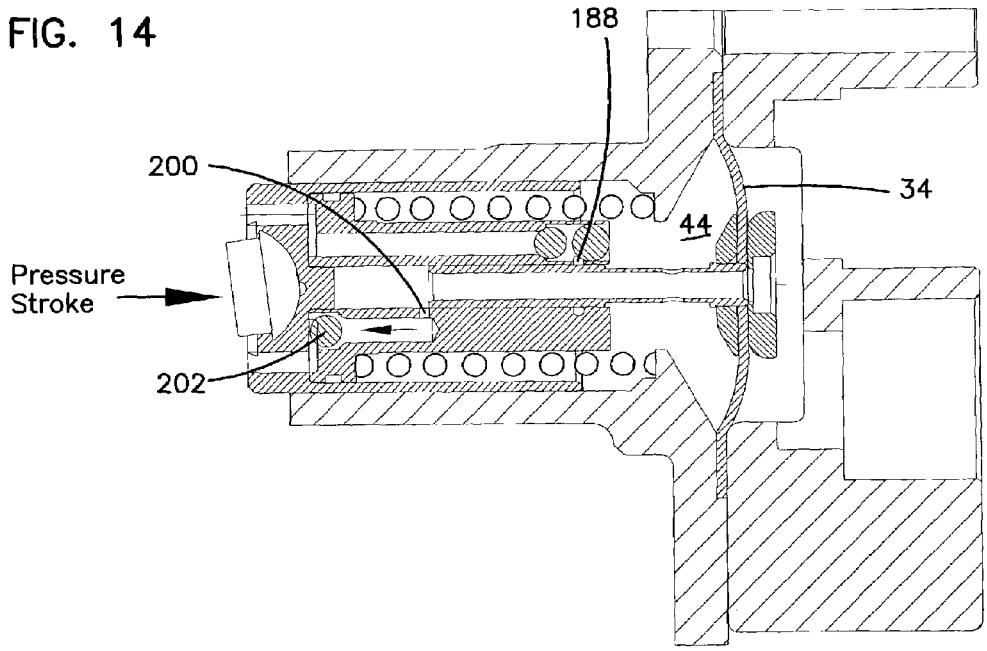

FIG. 14 shows the condition where there is too much hydraulic fluid in transfer chamber 44, and the pump is in the pressure stroke. In this case, since there is too much hydraulic fluid, diaphragm 34 is more rightwardly thereby causing first inlet spool valve 188 to close. First outlet spool valve 200, however, opens. Also, since pressure increases in transfer chamber 44 during the pressure stroke, second outlet check valve 202 opens so that hydraulic fluid can flow through the second communication path to the hydraulic fluid reservoir.

Figure 15:
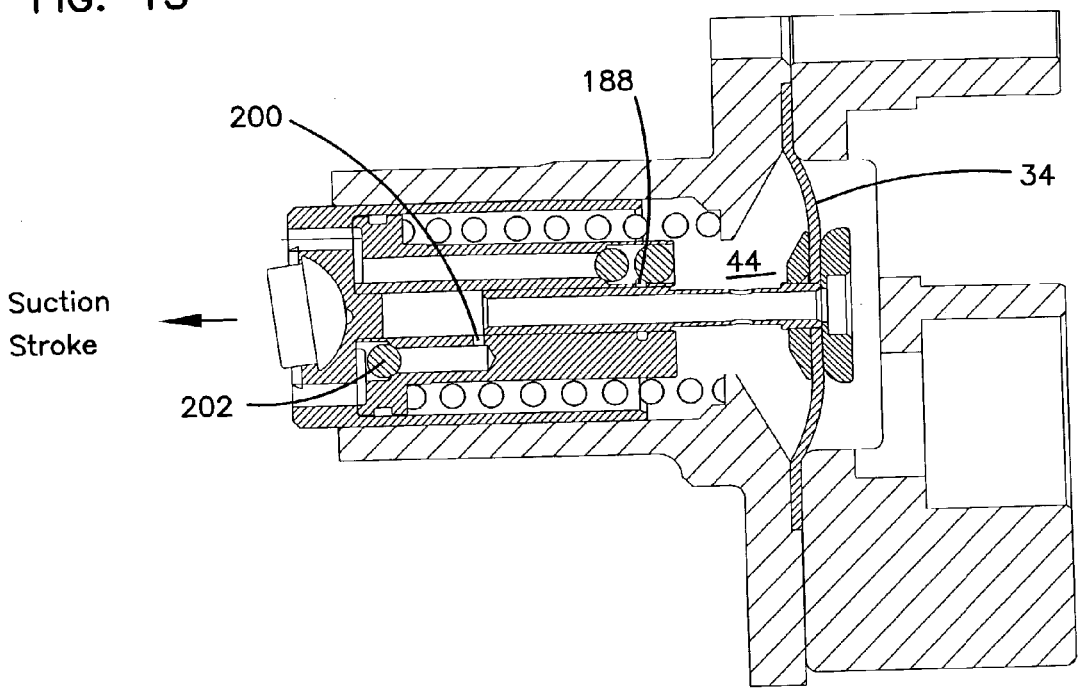

FIG. 15 shows the condition of too much hydraulic fluid in transfer chamber 44, and the pump in the suction stroke. Since there is too much hydraulic fluid, diaphragm 34 is rightwardly in FIG. 15 which causes first inlet spool valve 188 to be closed. On the other hand, first outlet spool valve 200 is open. Since the pump is in the suction stroke, pressure in transfer chamber 44 is reduced and lower than the pressure in the hydraulic fluid reservoir. Thus, the second outlet check valve 202 opens and hydraulic fluid flows from transfer chamber 44 through the second communication path to the hydraulic fluid reservoir. Thus, for the case of too much hydraulic fluid in transfer chamber 44, the valve system functions during both the pressure and suction strokes to allow hydraulic fluid to flow back to the hydraulic fluid reservoir.

Figure 16:
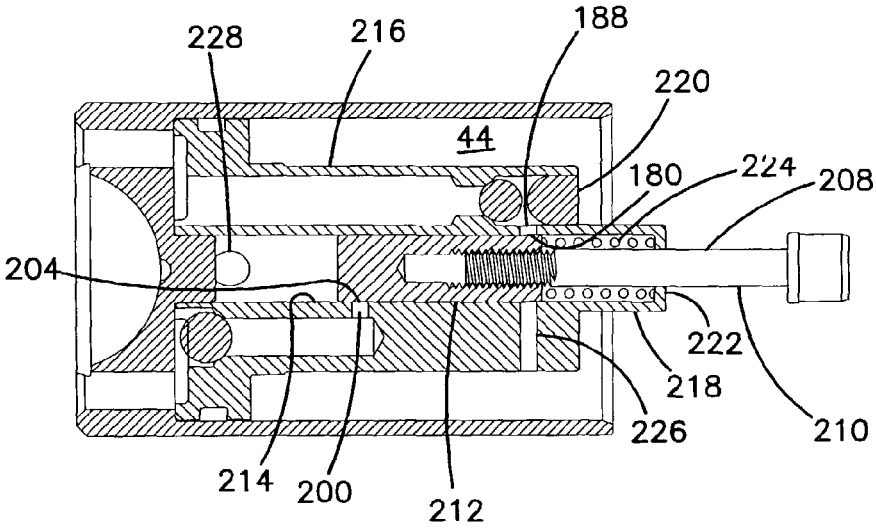
FIGS. 16–17 are partial cross-sectional views of a diaphragm pump similar to FIG. 11, but including a bias spring.
Figure 17:
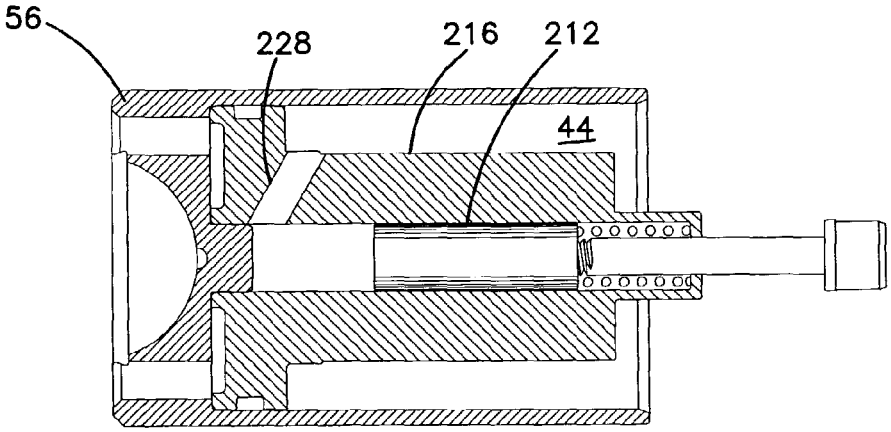

In the pump of FIGS. 11–15, there is no bias. As shown in FIGS. 16 and 17, a bias spring can be provided with only slight modification to valve system 182. With reference to FIG. 16, plunger 208 is similar to plunger 42 in FIG. 2. Plunger 208 has a solid stem 210, rather than a hollow stem as stem 178 in FIG. 11. Stem 210 is screwed or otherwise attached to valve spool 212. Valve spool 212 has a larger diameter than stem 210. As a consequence, there is a concentric space between stem 210 and the cylindrical wall of passage 214 in base section 216. Passage 214 is similar to passage 172 of FIG. 11, except that a cylindrical wall 218 extends beyond the end 220 of base section 216 and has an inwardly extending flange 222 which is similar to the structure of second base 64 of the pump of FIG. 2. Bias spring 224 is located in the concentric space between stem 210 on the cylindrical wall of passage 214 and extends between valve spool 212 and flange 222.

Since stem 210 is not hollow like the stem 178 of the pump of FIG. 11, a different way of providing fluid communication with first inlet spool valve 188 and second outlet spool valve 200 must be provided. A passage 226 extends through a solid part of base section 216 in radial alignment with port 180 of first inlet spool valve 188. In this way, when first inlet spool valve 188 is open because valve spool 212 has moved far enough to the left in FIG. 16, fluid can flow from or to transfer chamber 44 through passage 226, the concentric space in which bias spring 224 is located, and port 180.

As shown in FIG. 17, a passage 228 is provided between transfer chamber 44 and passage 214 in the portion of passage 214 between valve spool 212 and end portion 56. Then, when valve spool 212 moves far enough to the right in FIG. 16 so as to open port 204 of first outlet spool valve 200, hydraulic fluid can flow to or from transfer chamber 44 through passage 228, passage 214, and port 204.

Valve system 182 with or without a bias spring controls the volume of hydraulic fluid in the transfer chamber 44 behind the diaphragm 34, both by allowing hydraulic fluid to come in when there is not enough hydraulic fluid, as well as allowing hydraulic fluid to exit when there is excess hydraulic fluid. In this way, the valve system is an overfill preventive element.

The valve system 56 with no bias spring does not create a pressure differential across the diaphragm when the pump is operating. The valve system having a bias spring has a length as discussed hereinbefore that is relaxed and exerts no bias on the diaphragm when the correct amount of hydraulic fluid is in the hydraulic chamber, and has stiffness that provides a pressure differential across the diaphragm at the point that the valve system is open on the outlet side. The discussion hereinbefore with respect to the bias spring applies with respect to the pump having a valve system.

Numerous alternatives for providing an overfill preventive element for the transfer chamber in a diaphragm pump have been presented. Such overfill preventive elements protect the diaphragm from being deformed beyond a design limit due to the transfer chamber being filled beyond a maximum fill condition to an overfill condition. Thus, the diaphragm has longer life.

Finally, it is understood that the above specification, alternatives and data provide a complete description of the structure and use of the invention. However, since many embodiments of the invention can be made without departing from the spirit and scope of the invention, the invention resides in the claims hereinafter appended.

We claim:

1. A diaphragm pump for receiving drive power from a motor, comprising:

a housing having a pumping chamber adapted to contain fluid to be pumped, a transfer chamber adapted to contain hydraulic fluid, and a hydraulic fluid reservoir;

a diaphragm having a transfer chamber side and a pumping chamber side, said diaphragm being supported by said housing and forming with said housing said pumping chamber on said pumping chamber side and said transfer chamber on said transfer chamber side;

a piston in a cylinder in said housing adapted for reciprocating said diaphragm to have a power stroke and a suction stroke, said cylinder forming a portion of said transfer chamber, said piston including a first fluid communication path for the hydraulic fluid between said hydraulic fluid reservoir and said transfer chamber and a valve spool and a first valve in said first fluid communication path for selectively allowing flow of hydraulic fluid from said hydraulic fluid reservoir to said transfer chamber when said first valve is open; and an overfill preventive arrangement for said transfer chamber; wherein said overfill preventive arrangement includes a mechanical stop on said piston along a path of motion of said valve spool and a biasing element engaging said valve spool, wherein said biasing element has a spring constant counterbalancing a suction force and said mechanical stop directly engages said spool valve to stop movement of said valve spool during the suction stroke to position said valve spool to close said first valve and prevent overfilling of the transfer chamber to protect said diaphragm from being deformed beyond a design limit due to said transfer chamber being filled beyond a maximum fill condition to an overfill condition.

2. The diaphragm pump of claim 1 wherein said overfill preventive arrangement includes a second fluid communication path for the hydraulic fluid between said transfer chamber and said hydraulic fluid reservoir and a second valve in said second communication path for selectively allowing flow of hydraulic fluid from said transfer chamber to said hydraulic fluid reservoir when said second valve is open.

3. The diaphragm pump of claim 1 including a spring urging said diaphragm away from said pumping chamber with a first end of said spring connected with said valve spool and a second end of said spring supported by said piston for movement therewith, said spring having a spring constant obtained from $$k=A_p(P_s-P_n)/d_0$$

where $A_p$=piston area, $d_0$=overfill distance, $P_s$=pump design suction pressure, $P_n$=pump neutral operating pressure, and where pump design suction pressure ranges from 8.4 to 14.7 psi and pump neutral operating pressure ranges from zero to 8 psi.

4. A diaphragm pump for receiving drive power from a motor, comprising:

a housing having a pumping chamber adapted to contain fluid to be pumped, a transfer chamber adapted to contain hydraulic fluid, and a hydraulic fluid reservoir;

a diaphragm having a transfer chamber side and a pumping chamber side, said diaphragm being supported by said housing and forming with said housing said pumping chamber on said pumping chamber side and said transfer chamber on said transfer chamber side; and a piston in a cylinder in said housing adapted for reciprocating said diaphragm to have a power stroke and a suction stroke, said cylinder forming a portion of said transfer chamber, said piston including portions of first and second communication paths between said hydraulic fluid reservoir and said transfer chamber with a first valve system in said first communication path and a second valve system in said second communication path; wherein said first and second communication paths and said first and second valve systems maintain an appropriate amount of hydraulic fluid in said transfer chamber to prevent said diaphragm from being deformed beyond a design limit as said piston moves in said power stroke and said suction stroke;

wherein said first valve system includes an inlet spool valve and an inlet check valve and said second valve system includes an outlet spool valve and an outlet check valve.

5. The diaphragm pump of claim 4 wherein said piston includes a base section with a passage forming a portion of said first and second communication paths and said inlet and outlet spool valves include a common valve spool, said valve spool being free to move in said passage, said valve spool being connected to said diaphragm, said inlet spool valve including an inlet port in said base section and said outlet spool valve including an outlet port in said base section, said valve spool selectively moving in said passage to open one of said inlet and outlet ports to open one of said inlet and outlet spool valves, respectively, to allow hydraulic fluid to flow therethrough.

6. A diaphragm pump for receiving drive power from a motor, comprising:

a housing having a pumping chamber adapted to contain fluid to be pumped, a transfer chamber adapted to contain hydraulic fluid, and a hydraulic fluid reservoir;

a diaphragm having a transfer chamber side and a pumping chamber side, said diaphragm being supported by said housing and forming with said housing said pumping chamber on said pumping chamber side and said transfer chamber on said transfer chamber side;

a piston in a cylinder in said housing adapted for reciprocating said diaphragm to have a power stroke and a suction stroke, said cylinder forming a portion of said transfer chamber;

a fluid path for providing hydraulic fluid from said hydraulic fluid reservoir to said transfer chamber;

a biasing element biasing a valve spool and having a spring constant counterbalancing a suction force generated during said suction stroke, said valve spool when counterbalanced by said biasing element blocking said fluid path in said cylinder during said suction stroke and preventing said transfer chamber from becoming overfilled with hydraulic fluid to protect said diaphragm from being deformed beyond a design limit due to said transfer chamber being filled beyond a maximum fill condition; and a stop member extending from said piston along a path of movement of said valve spool, said stop member arranged and configured to stop movement of the valve spool before maximum compression of the biasing member.

7. The diaphragm pump of claim 6, wherein the mechanical stop is defined as a shoulder feature formed in an interior sidewall of the piston.

8. The diaphragm pump of claim 1 wherein the mechanical stop extends from a internal sidewall of the piston.

9. The diaphragm pump of claim 1 wherein the mechanical stop is positioned between opposing ends of the piston.

* * * * *